US010493750B2

(12) United States Patent
Nakamura et al.

(10) Patent No.: US 10,493,750 B2
(45) Date of Patent: Dec. 3, 2019

(54) METHOD FOR CONTROLLING LIQUID EJECTION APPARATUS

(71) Applicant: CANON KABUSHIKI KAISHA, Tokyo (JP)

(72) Inventors: Yohei Nakamura, Yokohama (JP); Kazuhiro Yamada, Yokohama (JP); Toru Nakakubo, Kawasaki (JP); Yoshiyuki Nakagawa, Kawasaki (JP); Naozumi Nabeshima, Tokyo (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 16/026,230

(22) Filed: Jul. 3, 2018

(65) Prior Publication Data

US 2019/0009524 A1 Jan. 10, 2019

(30) Foreign Application Priority Data

Jul. 7, 2017 (JP) ..... 2017-133995

(51) Int. Cl.

| | |
|---|---|
| ***B41J 29/38*** | (2006.01) |
| ***B41J 2/045*** | (2006.01) |
| ***B41J 2/165*** | (2006.01) |
| ***B41J 2/175*** | (2006.01) |

(Continued)

(52) U.S. Cl.

CPC ..... *B41J 2/04516* (2013.01); *B41J 2/0459* (2013.01); *B41J 2/04551* (2013.01); *B41J 2/04581* (2013.01); *B41J 2/1652* (2013.01); *B41J 2/175* (2013.01); *B41J 2/17596* (2013.01); *B41J 2/18* (2013.01); *B41J 2/185* (2013.01); *B41J 29/38* (2013.01); *B41J 2202/12* (2013.01)

(58) Field of Classification Search

USPC ..... 347/18

See application file for complete search history.

(56) References Cited

U.S. PATENT DOCUMENTS

| | | | | |
|---|---|---|---|---|
| 5,291,215 | A * | 3/1994 | Nozawa | B41J 2/1408 347/18 |
| 8,366,258 | B2 | 2/2013 | Nabeshima | |
| 9,975,347 | B2 | 5/2018 | Tozuka et al. | |

(Continued)

FOREIGN PATENT DOCUMENTS

| | | |
|---|---|---|
| EP | 2 193 924 A1 | 6/2010 |
| EP | 2 505 361 A1 | 10/2012 |

(Continued)

OTHER PUBLICATIONS

Extended European Search Report dated Dec. 3, 2018, in European Patent Application No. 18182127.3.

*Primary Examiner* — Lam S Nguyen

(74) *Attorney, Agent, or Firm* — Venable LLP

(57) ABSTRACT

A liquid ejection apparatus includes a supply control section that controls the supply and stop of a liquid to pressure chambers communicating with ejection ports to eject the liquid, and a negative pressure generating section that generates a negative pressure. The liquid ejection apparatus also includes a negative pressure control unit using the negative pressure generated by the negative pressure generating section to adjust the pressure of the liquid flowing through a collection channel. To stop a flow of the liquid, the supply control section stops the supply of the liquid, and then the negative pressure generating section is stopped.

7 Claims, 35 Drawing Sheets

(51) Int. Cl.
*B41J 2/185* (2006.01)
*B41J 2/18* (2006.01)

(56) References Cited

U.S. PATENT DOCUMENTS

| | | | |
|---|---|---|---|
| 2010/0091055 | A1 | 4/2010 | Kawakami et al. |
| 2016/0075144 | A1 | 3/2016 | Sugitani et al. |

FOREIGN PATENT DOCUMENTS

| | | | |
|---|---|---|---|
| EP | 3 144 153 | A1 | 3/2017 |
| JP | 2010-064389 | A | 3/2010 |
| JP | 2015-020286 | A | 2/2015 |
| JP | 2016-060155 | A | 4/2016 |

* cited by examiner

METHOD FOR CONTROLLING LIQUID EJECTION APPARATUS

BACKGROUND OF THE INVENTION

Field of the Invention

The present disclosure relates to a method for controlling a liquid ejection apparatus that ejects a liquid.

Description of the Related Art

For the purposes of urging the discharge of air bubbles in a flow path or suppressing the thickening of a liquid at ejection ports, some liquid ejection apparatuses allow the liquid to flow inside a liquid ejection head. Such liquid ejection apparatus is provided with a supply channel for supplying the liquid to the ejection ports and a collection channel for collecting the supplied liquid, and allows the liquid to flow by generating a pressure difference between the channels. Thus, the liquid can be circulated between a tank that stores the liquid and the liquid ejection head.

In the above liquid ejection apparatus, a pressure between the pressure inside the supply channel and the pressure inside the collection channel is applied to the ejection ports of the liquid ejection head. If the pressures inside the channels fluctuate when the circulation of the liquid is stopped, the pressure applied to the ejection ports also changes. As a result, the liquid may leak from the ejection ports.

In this regard, Japanese Patent Application Laid-Open No. 2016-60155 discloses a liquid ejection apparatus capable of reducing liquid leakage. The liquid ejection apparatus described in Japanese Patent Application Laid-Open No. 2016-60155 has a pressurizing space section that applies a positive pressure to the upstream side of a circulation flow path for circulating a liquid, and a negative pressure space section that applies a negative pressure to the downstream side of the circulation flow path for circulating the liquid. The liquid ejection apparatus reduces the leakage of the liquid by opening the pressurizing space section and the negative pressure space section to the atmosphere so that the pressure at the ejection ports is maintained at a negative pressure when finishing the circulation.

In a liquid ejection head, a liquid ejected from the ejection ports may adhere to the surface where the ejection ports are provided. Therefore, a wiping operation of wiping the surface where the ejection ports are provided with a cloth impregnated with a cleaning liquid is sometimes performed to remove the liquid adhering to the surface. If the wiping operation is performed in a state where the liquid is circulated, the cleaning liquid may enter the liquid ejection head through the ejection ports and be mixed into the circulated liquid. Meanwhile, in the case of a liquid ejection head capable of ejecting multiple colors of liquids, execution of the wiping operation may cause a certain color of liquid to enter another color of liquid through the ejection ports, leading to circulation of mixed colors of liquids. Moreover, not only liquid but also foreign objects such as dust may enter through the ejection ports during the wiping operation and intrude into the flow path. Therefore, the wiping operation needs to be performed after the circulation is stopped.

However, with the technique described in Japanese Patent Application Laid-Open No. 2016-60155, the circulation of the liquid is continued until a water head difference between a pressurizing tank and a negative pressure tank becomes zero, even after the pressurizing space section and the negative pressure space section are opened to the atmosphere. This increases the time until the circulation of the liquid is stopped.

SUMMARY OF THE INVENTION

It is an object of the present disclosure to provide a method for controlling a liquid ejection apparatus capable of stopping a liquid flow in a short period of time while suppressing liquid leakage from ejection ports.

A method for controlling a liquid ejection head according to the present disclosure is a method for controlling a liquid ejection apparatus including an ejection port that ejects a liquid, a pressure chamber communicating with the ejection port and having therein an energy generating element to generate energy for ejecting the liquid, first and second flow paths communicating with the pressure chamber to supply the liquid to the pressure chamber and to collect the liquid from the pressure chamber, a negative pressure generating section configured to generate a negative pressure, a negative pressure control section using the negative pressure generated by the negative pressure generating section to adjust a pressure of the liquid flowing through one of the first and second flow paths that is connected, and a supply control section configured to control the supply of the liquid to the pressure chamber and the stop thereof, the method including stopping the flow of the liquid by stopping the supply of the liquid by the supply control section and then stopping the negative pressure generating section.

Further features of the present invention will become apparent from the following description of exemplary embodiments with reference to the attached drawings.

DESCRIPTION OF THE EMBODIMENTS

Figure 1:
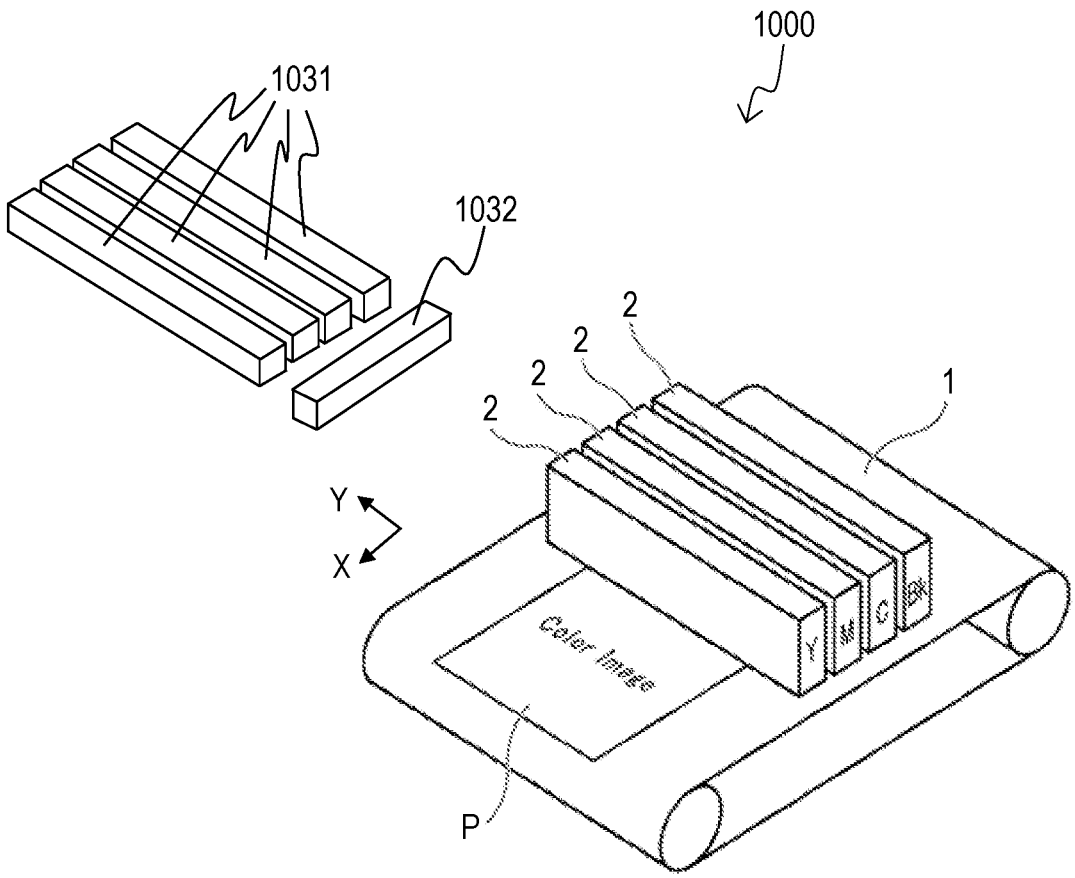
FIG. 1 is a perspective view schematically showing a liquid ejection apparatus according to a first embodiment of the present disclosure.

Preferred embodiments of the present disclosure will now be described in detail in accordance with the accompanying drawings. Note that, in the drawings, those having the same functions are denoted by the same reference numerals, and description thereof may be omitted.

First Embodiment (Description of Liquid Ejection Apparatus)

FIG. 1 is a perspective view schematically showing a liquid ejection apparatus according to a first embodiment of the present disclosure. A liquid ejection apparatus 1000 shown in FIG. 1 is a recording apparatus (inkjet recording apparatus) that performs recording on a recording medium P such as paper by ejecting ink as a liquid onto the recording medium P. The recording medium P may be cut into a standard size, such as cut paper, or may be in an elongated state, such as roll paper.

The liquid ejection apparatus 1000 includes a conveying section 1 that conveys the recording medium P, and liquid ejection heads 2 that perform recording on the recording medium P by ejecting liquids onto the recording medium P conveyed by the conveying section 1. The liquid ejection heads 2 are page-wide type (line type) liquid ejection heads that each have a length corresponding to the width of the recording medium P and are arranged approximately perpendicularly to an X direction that is a conveying direction of the recording medium P. The liquid ejection apparatus 1000 is a page-wide type (line type) recording apparatus that performs continuous one-pass recording on the recording medium P with the liquid ejection heads 2 while continuously or intermittently conveying the recording medium P with the conveying section 1.

The liquid ejection heads 2 according to this embodiment each eject one type of liquid. In the liquid ejection apparatus 1000, four liquid ejection heads 2 are arranged in parallel, which eject multiple types of liquids (in particular, cyan, magenta, yellow, and black inks), respectively.

Each of the liquid ejection heads 2 has ejection port arrays in which a plurality of ejection ports (FIGS. 8A to 8C) that eject the liquid are arranged. In this embodiment, twenty ejection port arrays are provided. This allows the liquid ejection apparatus 1000 to perform high-speed recording. Moreover, even if there are ejection ports causing ejection failure, complementary ejection of the liquid from ejection ports in another array located at positions corresponding to those ejection ports in the conveying direction of the recording medium P can suppress deterioration in quality of a recorded image due to the ejection failure. Therefore, the liquid ejection apparatus 1000 is highly reliable and suitable for commercial printing and the like. Note that a direction in which the ejection port arrays extend is referred to as an "ejection port array direction".

Each of the liquid ejection heads 2 is connected, in a fluid-flowable manner, to a tank (FIG. 11) that stores the liquid, through a flow path that supplies the liquid to the liquid ejection head 2. The tank may be divided into a main tank, a buffer tank, and the like. The liquid ejection head 2 is electrically connected to a control section (not shown) that transmits a logical signal for driving and controlling the liquid ejection head 2. The liquid ejection apparatus 1000 according to this embodiment is configured to allow the liquid in the ejection ports that eject the liquid (liquid in a pressure chamber that stores the liquid to be ejected) to flow by circulating the liquid between the tank and the liquid ejection head, but may have another configuration. For example, the liquid ejection apparatus 1000 may be configured such that two tanks are provided on the upstream and downstream sides of the liquid ejection head and the liquid in the ejection ports is moved by allowing the liquid to flow from one of the tanks to the other tank, rather than circulating the liquid. Note that the liquid ejection head 2 is not limited to the page-wide type but may also be a serial type that performs recording while scanning on the recording medium P. Also, the liquid ejection method for the liquid ejection head 2 is not particularly limited. For example, methods that can be applied as the liquid ejection method include a thermal method for ejecting the liquid by generating air bubbles with a heater that is a heating element, a piezo method using a piezo element or other various liquid ejection methods.

In this embodiment, the liquid ejection heads 2 are mounted on a carriage (not shown), and can be moved to a position not facing the recording medium P in a Y direction approximately perpendicular to the X direction by the carriage, and are also moved to a position not facing the recording medium P during recording standby when recording is not performed. The liquid ejection apparatus 1000 includes capping members 1031 for capping the liquid ejection heads 2 at the position not facing the recording medium P, and a wiping mechanism 1032 for performing a wiping operation to wipe off the surfaces of the liquid dejection heads 2 where the ejection ports are provided.

(Description of Liquid Ejection Head Structure)

Figure 2A:
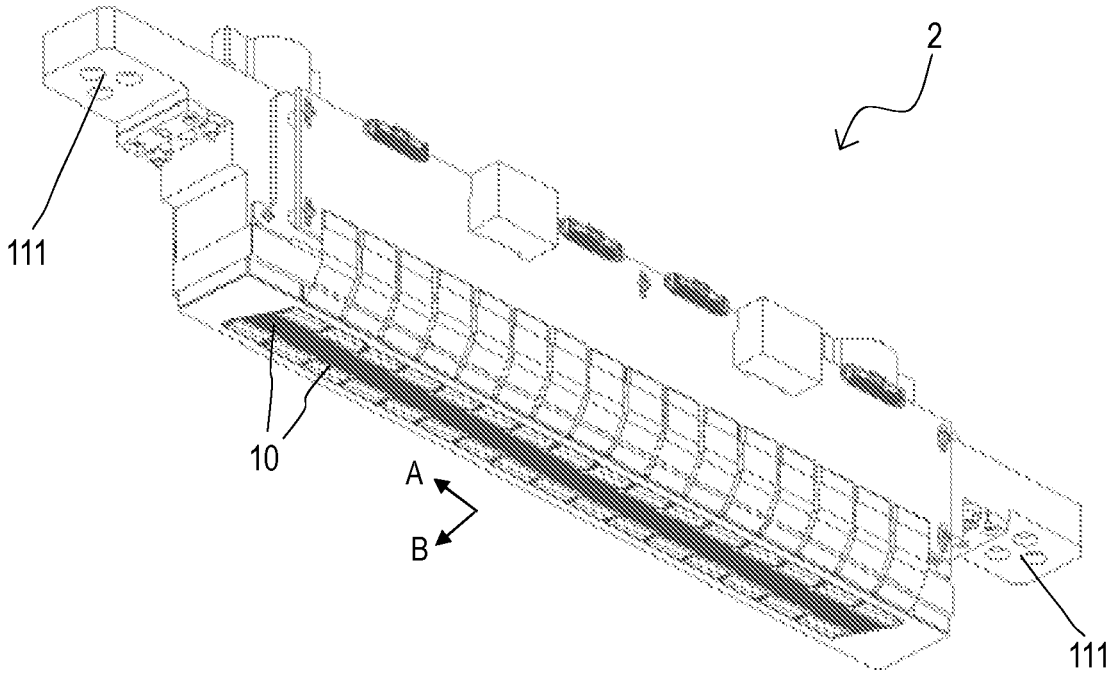
FIGS. 2A and 2B are perspective views showing a liquid ejection head according to the first embodiment of the present disclosure.
Figure 2B:
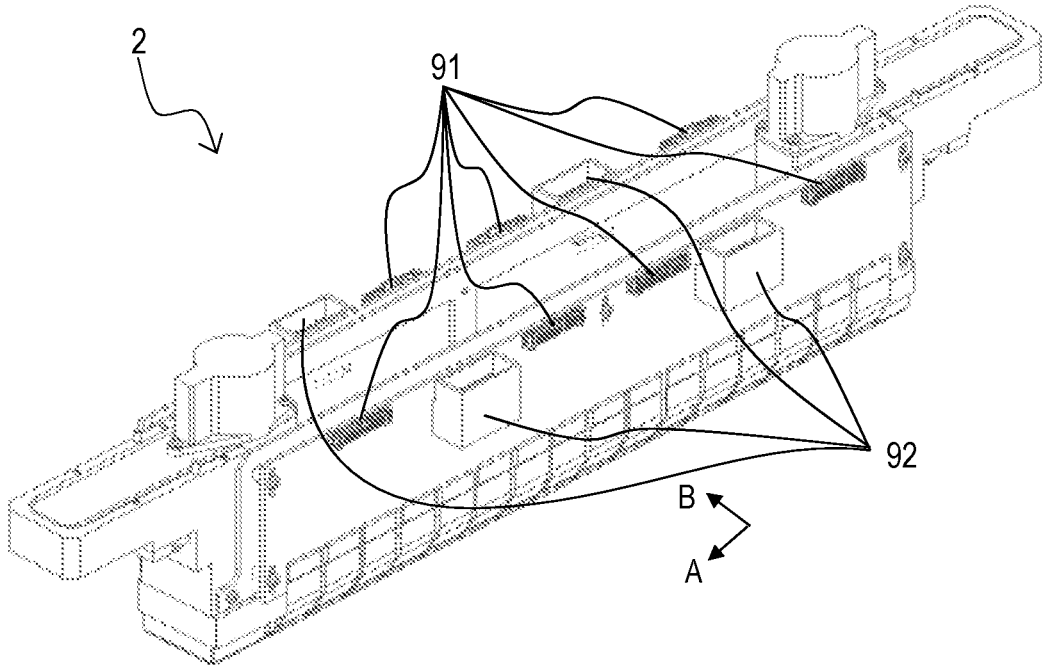

FIGS. 2A and 2B are perspective views showing the liquid ejection head 2. FIG. 2A is a view of the liquid ejection head 2 as seen from obliquely below, while FIG. 2B is a view of the liquid ejection head 2 as seen from obliquely above. As shown in FIGS. 2A and 2B, the liquid ejection head 2 includes a plurality of (in the example of FIGS. 2A and 2B, sixteen) element substrates 10 for ejecting the liquid. The liquid ejection head 2 includes a liquid connection section 111 for connecting to the main body of the liquid ejection apparatus 1000 in a fluid-flowable manner, signal input terminals 91 to input logical signals for controlling the element substrates 10, and power supply terminals 92 to supply power for driving the element substrates 10. The signal input terminals 91 and the power supply terminals 92 are arranged on either side (both sides) of the liquid ejection head 2 in a transverse direction B approximately perpendicular to a longitudinal direction A. This is in order to reduce voltage drop and signal transmission delay occurring in wiring sections provided on the element substrates 10.

Figure 3:
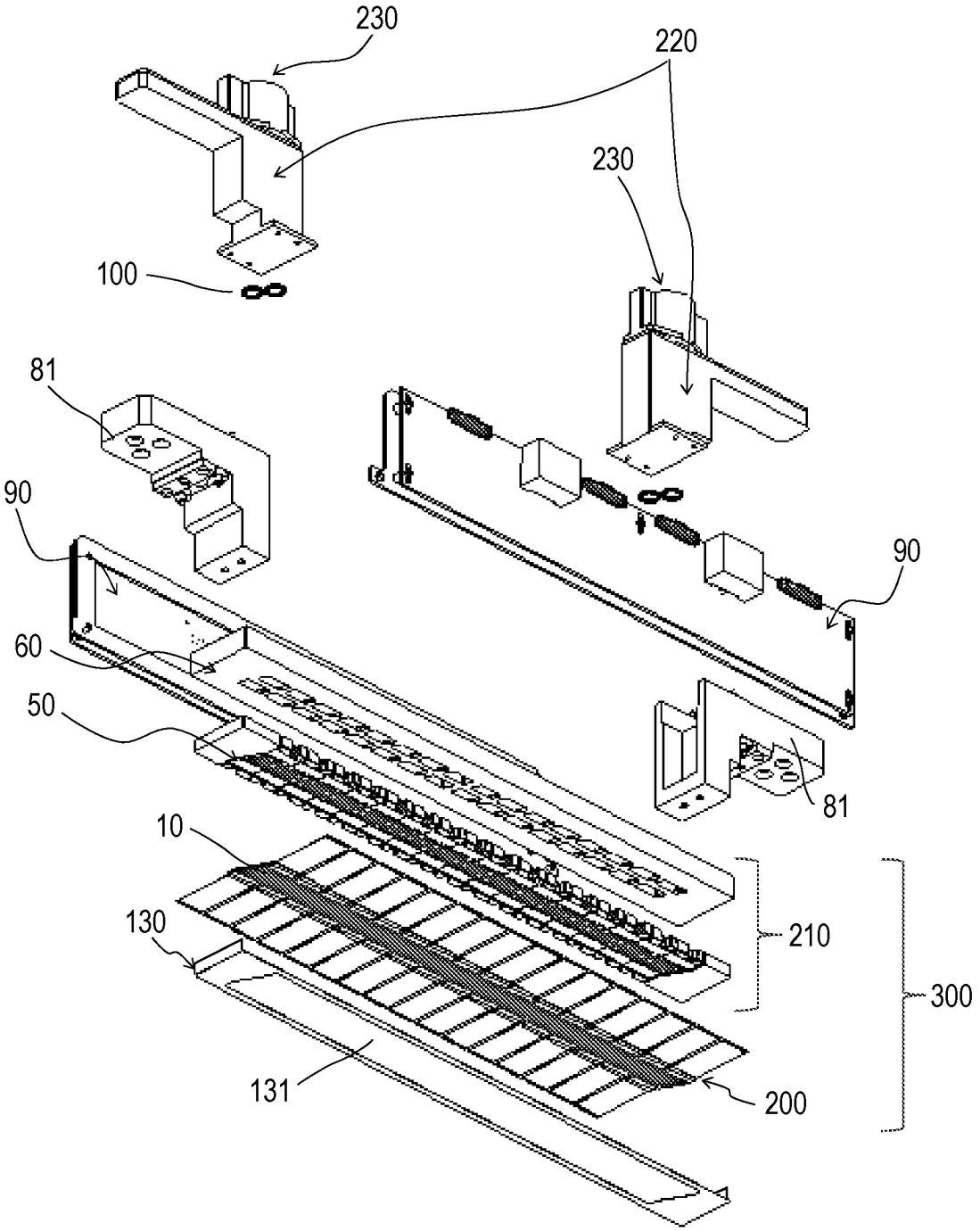
FIG. 3 is an exploded perspective view showing the liquid ejection head according to the first embodiment of the present disclosure.

FIG. 3 is an exploded perspective view showing respective parts or units included in the liquid ejection head 2. As shown in FIG. 3, the liquid ejection head 2 includes a liquid ejection unit 300 that ejects the liquid two liquid supply units 220 that supply the liquid to the liquid ejection unit 300 and an electrical circuit board 90 to input signals from the main body of the liquid ejection apparatus 1000.

The liquid ejection unit 300 includes a plurality of ejection modules 200 and a flow path member 210, and has a cover member 130 attached to its surface on the recording medium side. The cover member 130 is a member with a frame-shaped surface having an elongated opening 131 provided therein. The element substrates 10 and seal sections 110 (FIGS. 7A and 7B) included in the ejection modules 200 are exposed from the opening 131. A frame part around the opening 131 has a function as an abutting surface that abuts against the capping member 1031 during recording standby. Therefore, it is preferable that an adhesive, a sealant, a filler, and the like are applied around the opening 131 to fill unevenness or a gap on the ejection port surface of the liquid ejection unit 300, thereby forming a closed space during capping. The flow path member 210 has a configuration in which a first flow path member 50 and a second flow path member 60 are laminated. Liquid ejection unit supporting sections 81 for supporting the liquid ejection unit 300 are connected to both ends of the second flow path member 60. The liquid ejection unit 300 is mechanically connected to the carriage of the liquid ejection apparatus 1000 by the liquid ejection unit supporting sections 81 for positioning of the liquid ejection unit 300.

The liquid supply units 220 and the electrical circuit board 90 are connected to the liquid ejection unit supporting section 81. The liquid supply units 220 each include a negative pressure control unit 230. The negative pressure control unit 230 is a negative pressure control section that adjusts the pressure in a flow path connected to the negative pressure control unit 230. The negative pressure control unit 230 is, for example, a back pressure regulator set to control the pressure with a negative pressure.

The liquid ejection unit supporting sections 81 each have an opening (not shown) provided therein, into which a joint rubber 100 is inserted. The liquid supplied to the liquid supply units 220 from the main body of the liquid ejection apparatus 1000 is guided to the second flow path member 60 included in the liquid ejection unit 300 through the joint rubbers 100.

Next, description is given of a configuration of the flow path member 210 included in the liquid ejection unit 300. The flow path member 210 distributes the liquid supplied from the liquid supply units 220 to the respective ejection modules 200, and returns the liquid returning from the ejection modules 200 to the liquid supply units 220. The second flow path member 60 of the flow path member 210 is a flow path member having a common supply channel (FIG. 5) and a common collection channel (FIG. 5) formed therein, both of which constitute a part of a circulation flow path. The second flow path member 60 according to this embodiment has a function to secure the rigidity of the liquid ejection head 2. Thus, the material of the second flow path member 60 preferably has sufficient corrosion resistance to the liquid and high mechanical strength. To be more specific, the material of the second flow path member 60 is preferably a metal material such as SUS (stainless used steel) and Ti (titanium) or ceramic such as alumina.

FIGS. 4A to 4E are diagrams showing the first flow path member 50 and the second flow path member 60.

Figure 4A:
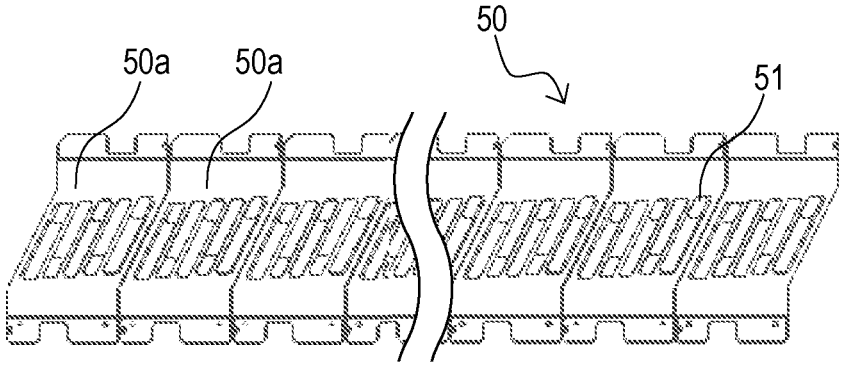
FIGS. 4A, 4B, 4C, 4D and 4E are plan views showing a flow path member according to the first embodiment of the present disclosure.
Figure 4B:
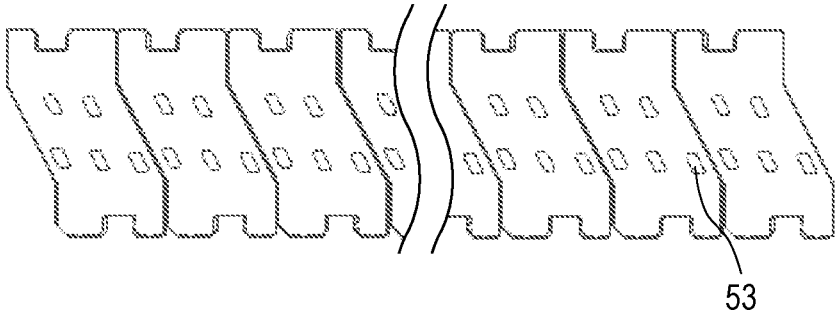
Figure 4C:
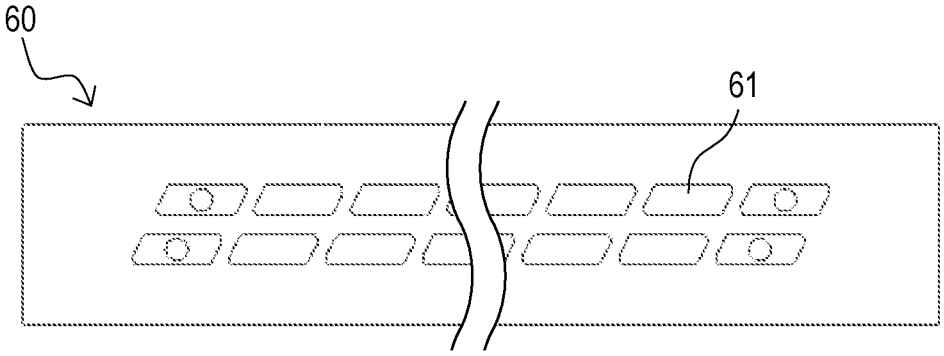
Figure 4D:
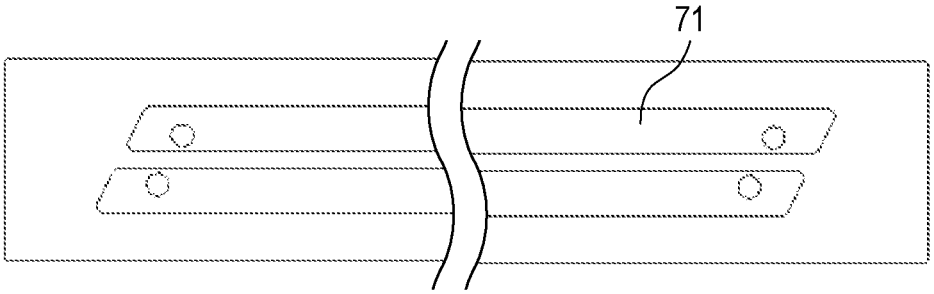
Figure 4E:
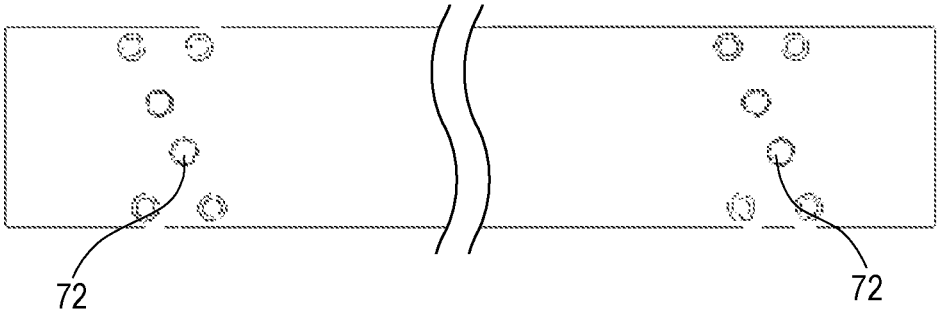

FIG. 4A shows a surface of the first flow path member 50 on the side where the ejection modules 200 are mounted, while FIG. 4B shows a surface on the reverse side abutting against the second flow path member 60. FIG. 4C shows a surface of the second flow path member 60 on the side abutting against the first flow path member 50. FIG. 4D shows a cross-section of the center part of the second flow path member 60 in its thickness direction. FIG. 4E shows a surface of the second flow path member 60 on the side abutting against the liquid supply units 220. The first flow path member 50 and the second flow path member 60 are joined together such that the abutting surfaces shown in FIGS. 4B and 4C face each other.

The first flow path member 50 includes a plurality of members 50*a* corresponding to the plurality of ejection modules 200, respectively, and the members 50*a* are arranged adjacent to each other. Such a structure of the first flow path member 50 being divided into the plurality of members 50*a* is suitable for a relatively long scale liquid ejection head 2 that supports a length of B2 size or more, in particular, since the structure can easily support the length of the liquid ejection head 2.

The surface of the first flow path member 50 on the side where the ejection modules 200 are mounted has communication ports 51 formed therein. The first flow path member 50 communicates with the ejection modules 200 through the communication ports 51 in a fluid-flowable manner. Also, the abutting surface of the first flow path member 50 has individual communication ports 53 formed therein. The individual communication ports 53 communicate, in a fluid-flowable manner, with communication ports 61 formed in the abutting surface of the second flow path member 60.

The second flow path member 60 has communication ports 72 formed therein, which communicate with the openings for the joint rubbers 100, and the second flow path member 60 communicates with the liquid supply units 220 through the communication ports 72 in a fluid-flowable manner. Also, the second flow path member 60 has two common flow channels 71 provided therein, as shown in FIG. 4D. One of the common flow channels 71 forms the common supply channel (FIG. 5) to supply the liquid to the element substrates 10, and the other one forms the common collection channel (FIG. 5) to collect the liquid from the element substrates 10.

Figure 5:
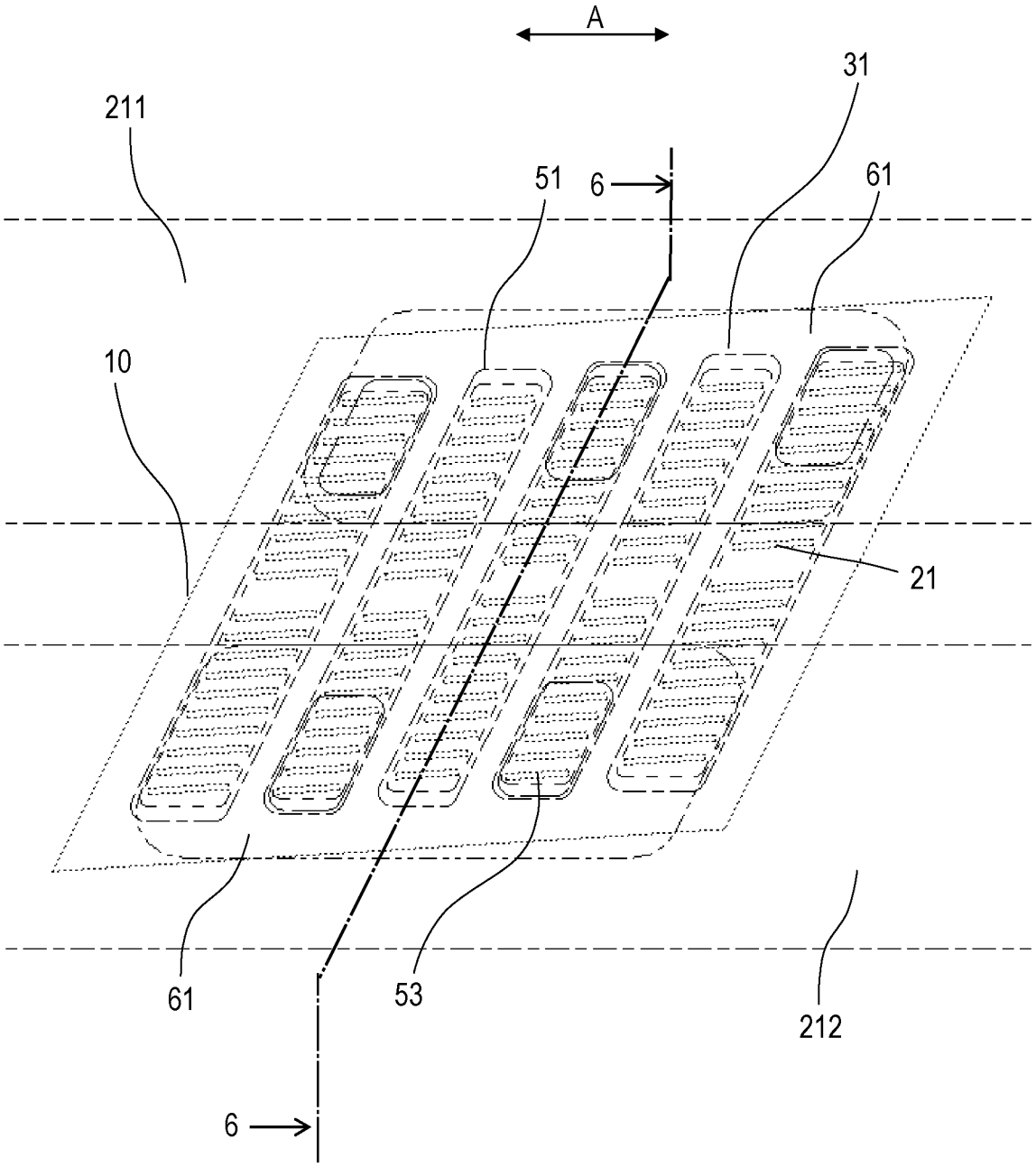
FIG. 5 is a perspective view showing a flow path member according to the first embodiment of the present disclosure.

FIG. 5 is a perspective view showing a fluid-flowable connection relationship between the element substrate 10 and the flow path member 210. As shown in FIG. 5, a common supply channel 211 and a common collection channel 212 are provided in the flow path member 210 as first and second flow paths extending in the longitudinal direction A of the liquid ejection head 2. As shown in FIG. 5, a liquid supply channel is formed, which communicates with the communication ports 51 of the first flow path member 50 through the common supply channel 211 from the communication ports 72 of the second flow path member 60. Likewise, a liquid collection channel is also formed, which communicates with the communication ports 51 of the first flow path member 50 through the common collection channel 212 from the communication ports 72 of the second flow path member 60.

Figure 6:
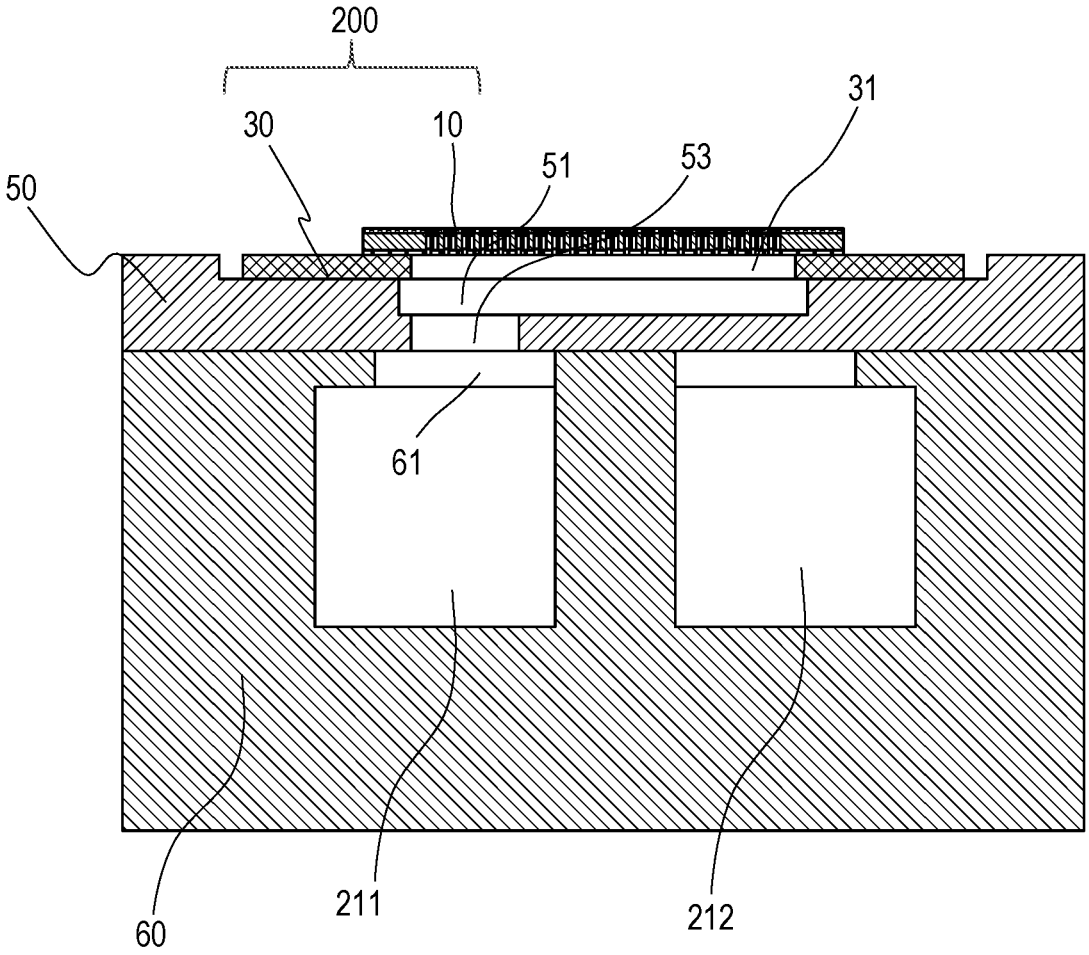
FIG. 6 is a cross-sectional view showing the flow path member according to the first embodiment of the present disclosure.

FIG. 6 is a cross-sectional view taken along the line 6-6 in FIG. 5. As shown in FIG. 6, the common supply channel 211 communicates with the ejection module 200 through the communication port 61, the individual communication port 53, and the communication port 51. Although not shown in FIG. 6, the common collection channel 212 communicates with the ejection module 200 through the same flow path in another cross-section as shown in FIG. 5. Each ejection module 200 has a flow path formed therein, which communicates with the ejection ports (FIGS. 8A to 8C) formed in the element substrates 10 and is formed such that some of or all of the liquid supplied can return passing through the ejection ports (pressure chamber) in a state of stopping the ejection operation. Moreover, the common supply channel 211 and the common collection channel 212 are connected to the negative pressure control units 230 through the liquid supply units 220. A differential pressure between the common supply channel 211 and the common collection channel 212 generates a flow from the common supply channel 211 to the common collection channel 212 through ejection ports 13 (pressure chamber) in the element substrate 10.

(Description of Ejection Module)

Figure 7A:
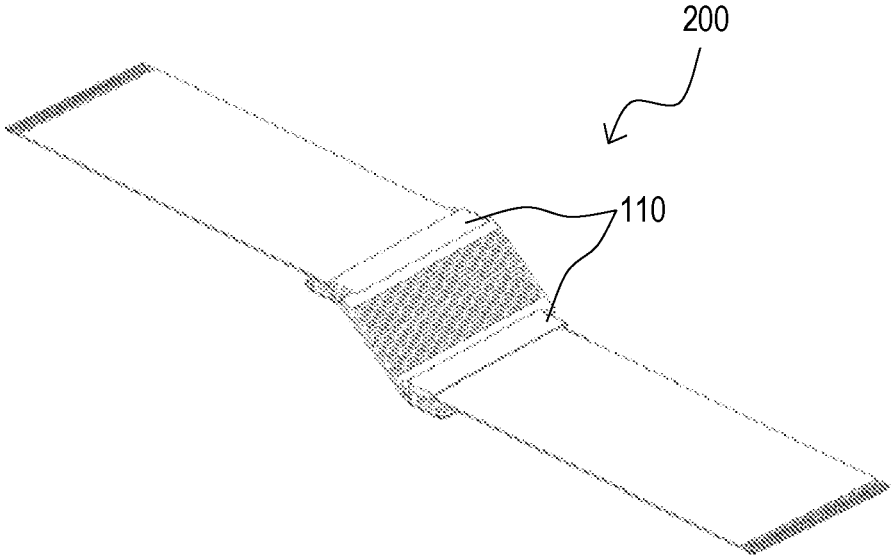
FIGS. 7A and 7B are perspective views showing an ejection module according to the first embodiment of the present disclosure.
Figure 7B:
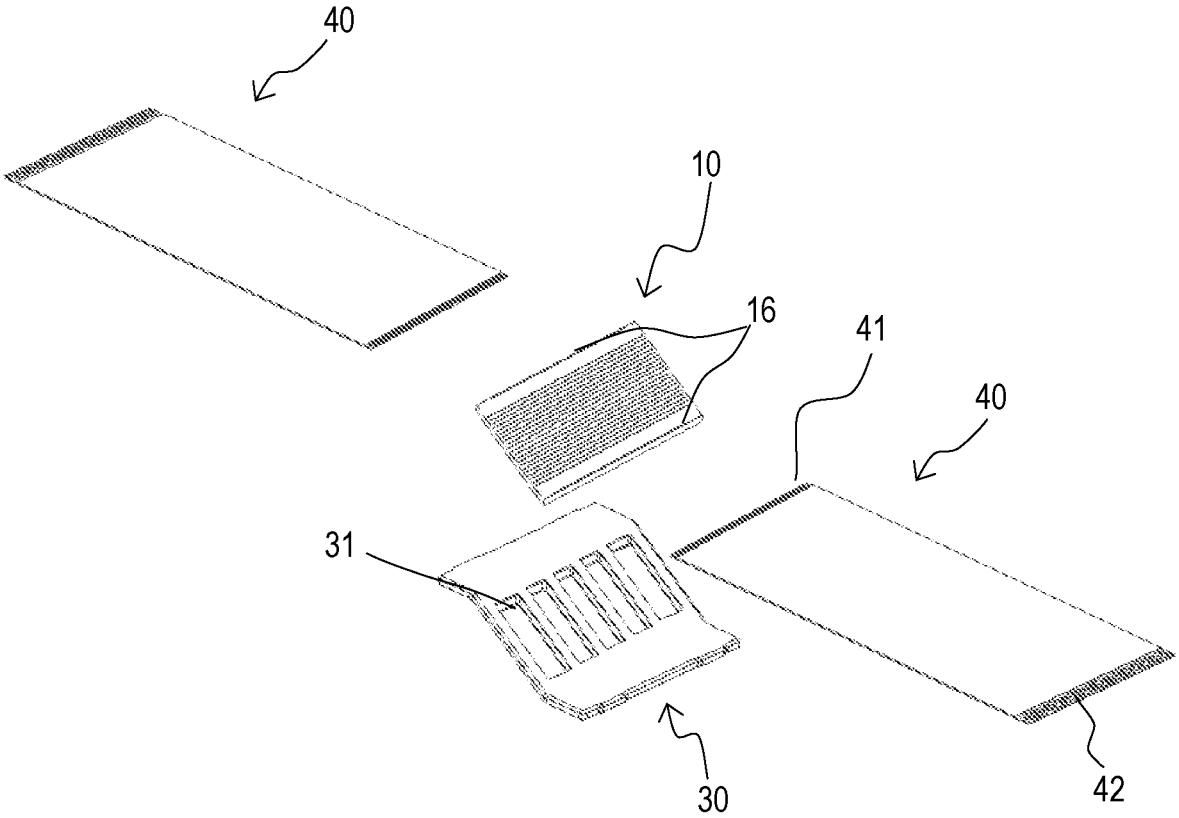

FIGS. 7A and 7B are diagrams showing the ejection module 200. To be more specific, FIG. 7A is a perspective view of one of the ejection modules 200, while FIG. 7B is an exploded view thereof.

As for a method for manufacturing the ejection module 200, first, the element substrate 10 and flexible wiring boards 40 are attached onto a supporting member 30 with liquid communication ports 31 previously provided therein. Then, terminals 16 on the element substrate 10 are electrically connected by wire bonding to terminals 41 on the flexible wiring boards 40. Thereafter, the wire bonding sections (electrical connection sections) are covered with the seal sections 110 for sealing. Terminals 42 of the flexible wiring boards 40 opposite to the element substrate 10 are electrically connected to the electrical circuit boards 90. The supporting member 30 is a support that supports the element substrate 10, and is also a flow path member through which the element substrate 10 and the flow path member 210 communicate with each other in a fluid-flowable manner. Thus, the supporting member 30 preferably has high flatness and can be bonded to the element substrate with sufficiently high reliability. As the material of the supporting member 30, alumina or a resin material, for example, is preferable.

In the example of FIGS. 7A and 7B, the terminals 16 are disposed at both side sections (respective long-side sections of the element substrate 10) along the direction of the plurality of ejection port arrays on the element substrate 10. Also, as for the flexible wiring boards 40 electrically connected to the terminals 16, two flexible wiring boards are disposed for one element substrate 10. This is because twenty ejection port arrays provided on the element substrate 10 increase the number of wirings. More specifically, it is intended to reduce voltage drop and signal transmission delay occurring in wiring sections inside the element substrate 10 by reducing the maximum distance from the terminals 16 to recording elements 15 provided corresponding to the ejection port arrays. Moreover, the liquid communication ports 31 in the supporting member 30 have openings across all of the ejection port arrays provided on the element substrate 10.

(Description of Structure of Element Substrate)

Figure 8A:
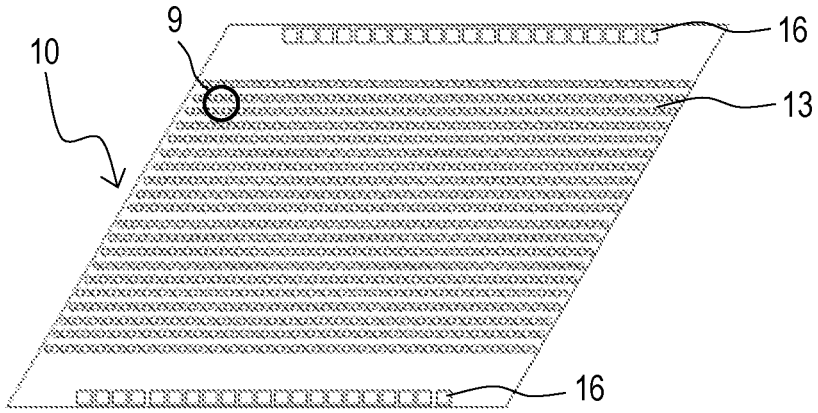
FIGS. 8A, 8B and 8C are schematic views showing an element substrate according to the first embodiment of the present disclosure.
Figure 8B:
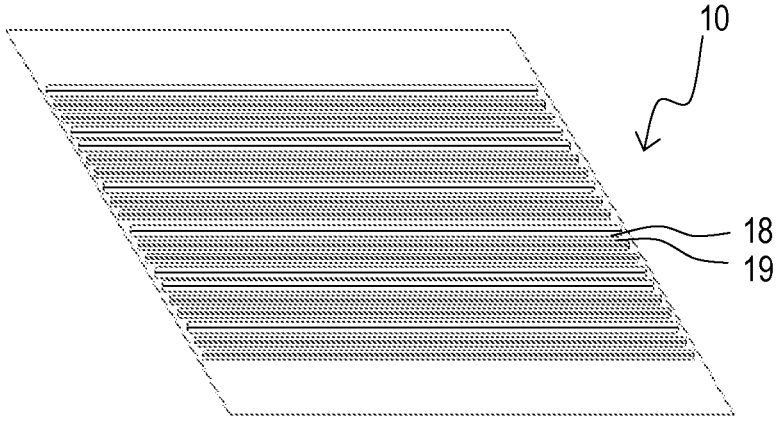
Figure 8C:
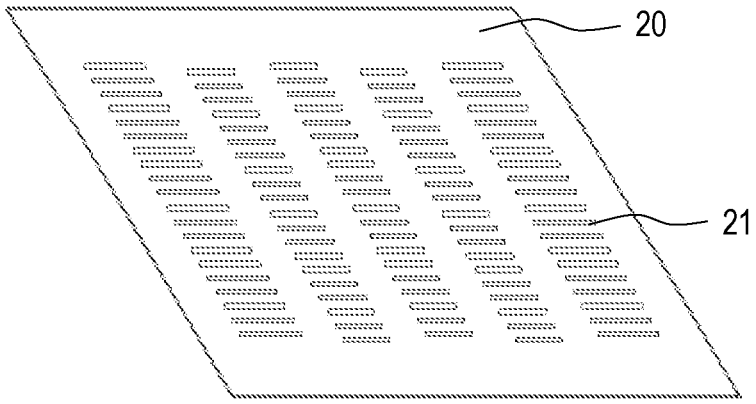

FIGS. 8A to 8C are diagrams for explaining the structure of the element substrate 10. To be more specific, FIG. 8A is a schematic diagram showing a surface of the element substrate 10 where the ejection ports 13 are arranged, while FIG. 8C is a schematic diagram showing the reverse side of the surface shown in FIG. 8A. FIG. 8B is a schematic diagram showing the surface of the element substrate 10 when a cover member 20 provided on the reverse side of the element substrate 10 is removed. As shown in FIG. 8A, a plurality of ejection port arrays having the ejection ports 13 arranged therein are formed in an ejection port formation member 12 of the element substrate 10.

Figure 9:
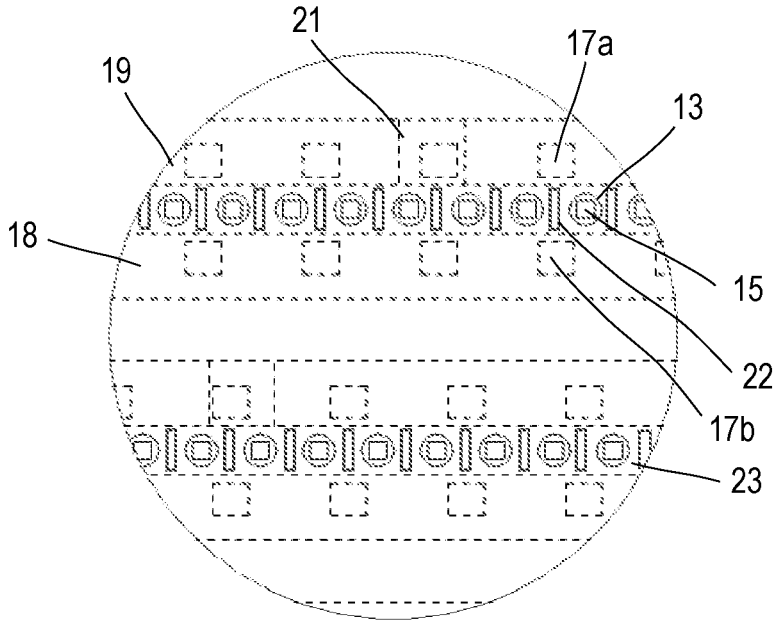
FIG. 9 is an enlarged view showing the element substrate according to the first embodiment of the present disclosure.

FIG. 9 is an enlarged view of a portion indicated by 9 in FIG. 8A. As shown in FIG. 9, the recording elements 15 which are heating elements for foaming the liquid with thermal energy are arranged, as energy generating elements for generating energy to eject the liquid, at the positions corresponding to the respective ejection ports 13. Also, pressure chambers 23 including the recording elements 15 therein are compartmentalized by partitions 22. The recording elements 15 are electrically connected to the terminals 16 in FIG. 8A by electrical wiring (not shown) provided in the element substrate 10. The liquid is boiled by generating heat based on a pulse signal inputted from a control circuit in the liquid ejection apparatus 1000 through the electrical wiring boards 90 and the flexible wiring boards 40. The liquid is ejected from the ejection ports 13 by the force of bubbles generated by the boiling.

On the back side of the element substrate 10, liquid supply paths 18 and liquid collection paths 19 are alternately provided along the ejection port array direction. The liquid supply paths 18 and the liquid collection paths 19 are flow paths extending in the direction of the ejection port arrays provided on the element substrate 10, and communicate with the ejection ports 13 through supply ports 17*a* and collection ports 17*b*, respectively. The supply ports 17*a* are used to supply the liquid to the pressure chambers 23, while the collection ports 17*b* are used to collect the liquid from the pressure chambers 23. The liquid in the pressure chambers 23 is circulated between the pressure chambers 23 and the outside through the supply ports 17*a* and the collection ports 17*b*.

As shown in FIG. 8C, the sheet-like cover member 20 is laminated on the back of the surface of the element substrate 10 where the ejection ports 13 are formed. The cover member 20 has a plurality of openings 21 provided therein, which communicate with the liquid supply paths 18 and the liquid collection paths 19. In this embodiment, five openings 21 are provided for each liquid supply path 18 and each liquid collection path 19. As shown in FIG. 9, the openings 21 in the cover member 20 communicate with the plurality of communication ports 51 shown in FIG. 4A.

Figure 29:
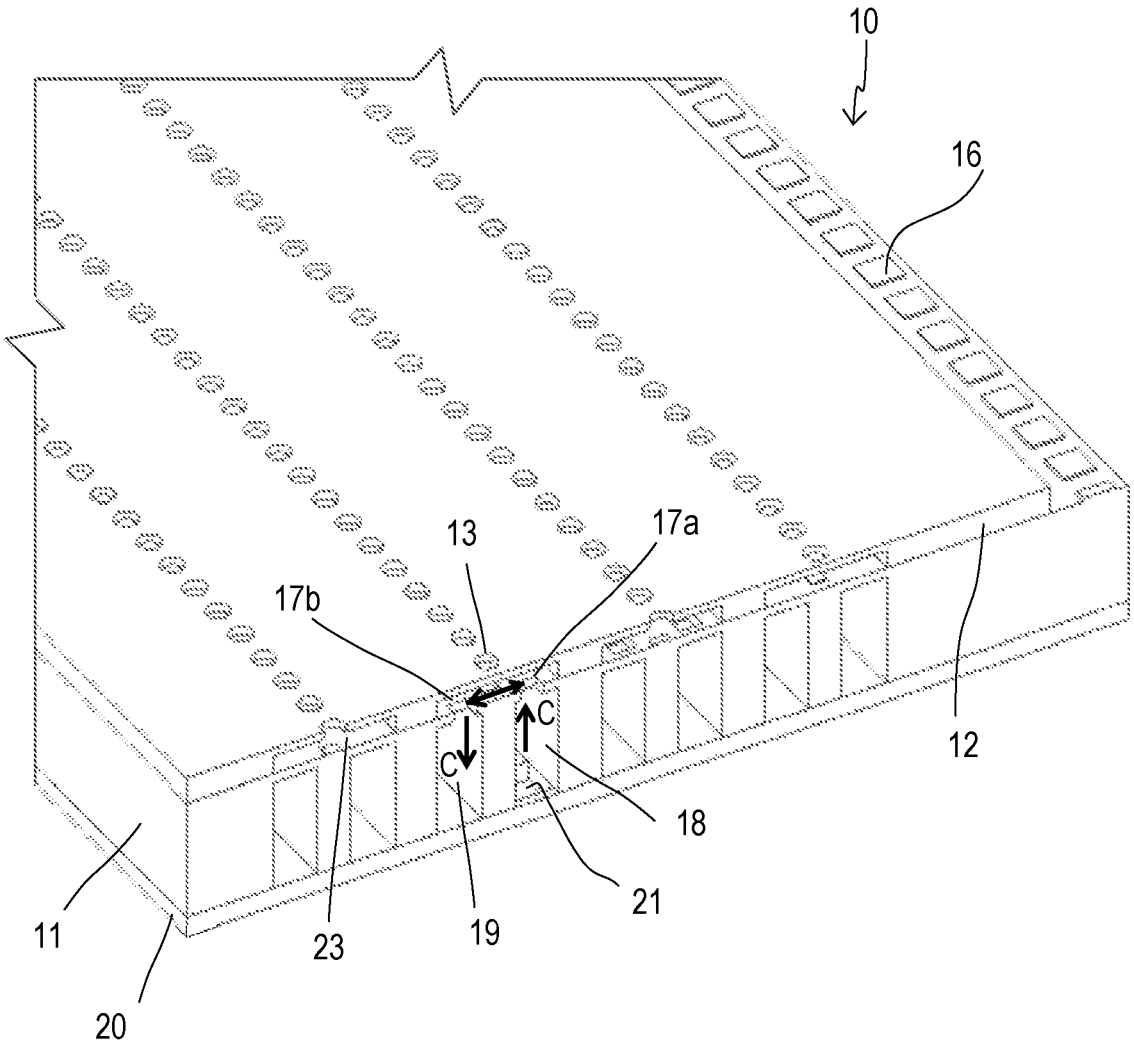
FIG. 29 is a cross-sectional perspective view showing an element substrate according to the fourth embodiment of the present disclosure.

The cover member 20 has a function as a cover that forms a part of the walls of the liquid supply paths 18 and the liquid collection paths 19 formed in the element substrate 10 (FIG. 29). The cover member 20 preferably has sufficient corrosion resistance to the liquid. Also, from the viewpoint of preventing color mixing, high precision is required for the opening shape and the opening positions of the openings 21. Therefore, it is preferable that a photosensitive resin material or a silicon plate is used as the material of the cover member 20, and that the openings 21 are provided by photolithography. Thus, the cover member 20 alters the pitch of the flow paths with the openings 21. Therefore, considering pressure loss, it is preferable that the cover member 20 is thin and made of a film member.

(Description of Circulation Flow Path)

Figure 10:
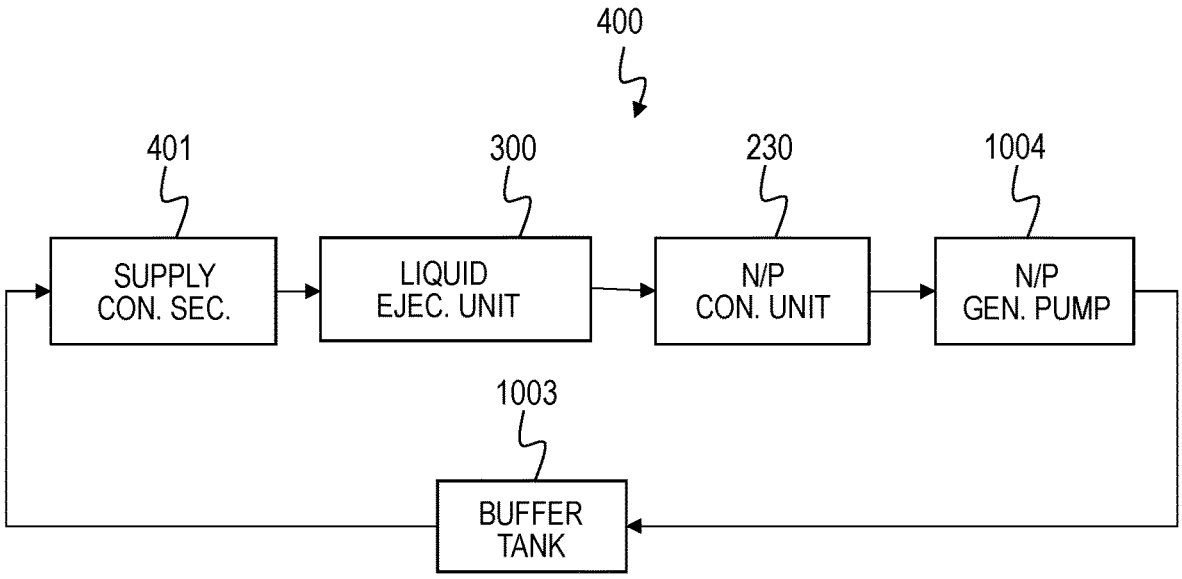
FIG. 10 is a block diagram showing a fluid circuit according to the first embodiment of the present disclosure.

FIG. 10 is a block diagram showing a fluid circuit according to this embodiment. A fluid circuit 400 shown in FIG. 10 includes a liquid ejection unit 300, a supply control section 401, a buffer tank 1003, a negative pressure control unit 230, and a negative pressure generating pump 1004. The buffer tank 1003 and the supply control section 401 are provided upstream of the liquid ejection unit 300. The supply control section 401 controls the supply of a liquid in the buffer tank 1003 to the element substrates 10 (in particular, the pressure chambers 23) as well as the suspension of the supply. The negative pressure control unit 230 and the negative pressure generating pump 1004 are provided downstream of the liquid ejection unit 300. The negative pressure generating pump 1004 is used to generate a negative pressure, and the negative pressure control unit 230 uses the negative pressure to control (adjust) the pressure in the connected flow paths.

The supply control section 401 in this embodiment is an opening/closing valve to open/close the flow path between the buffer tank 1003 and the liquid ejection unit 300 (FIG. 11), and adds a water head of the buffer tank 1003 to the upstream of the liquid ejection unit 300 when set in an open state.

The negative pressure control unit 230 operates so as to maintain the pressure upstream of the negative pressure control unit 230 within a certain range centered on a set negative pressure that is a desired pressure, even if a flow rate in a circulation flow path to circulate the liquid is changed by a difference in recording duty. For example, when the upstream pressure gets higher than the set negative pressure, the negative pressure control unit 230 operates to lower the upstream pressure by using the negative pressure generated by the negative pressure generating pump 1004. When the supply control section 401 is in a supply state, that is, the opening/closing valve is opened, the liquid in the liquid ejection unit 300 is circulated by a pressure difference between the pressure upstream of the ejection ports 13 and the pressure downstream of the ejection ports 13. In this embodiment, the set negative pressure of the negative pressure control unit 230 and the water head in the buffer tank 1003 are set such that the pressure in the ejection ports 13 becomes a slightly negative pressure (for example, −3 kPa).

Figure 11:
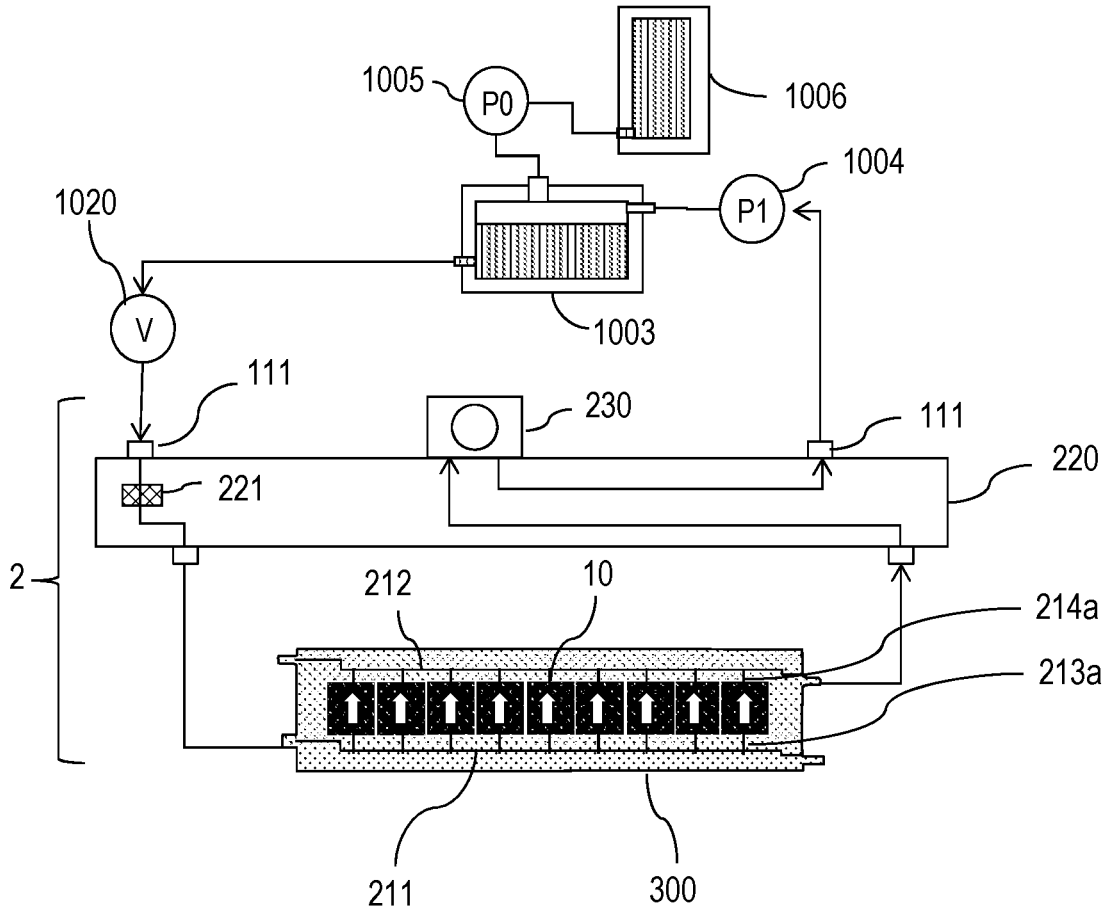
FIG. 11 is a schematic view showing a liquid circulation flow path according to the first embodiment of the present disclosure.

FIG. 11 is a schematic diagram showing a circulation flow path to circulate the liquid in this embodiment. Although, to simplify the illustration, FIG. 11 shows only a flow path through which a liquid of one of four colors flows, circulation flow paths for the four colors are provided in the main body of the liquid ejection apparatus 1000. The buffer tank 1003 used as a sub-tank is connected to a main tank 1006. The buffer tank 1003 has an atmosphere communication port (not shown) through which the inside and outside of the tank communicate with each other, and is capable of discharging air bubbles in the liquid to the outside. The buffer tank 1003 is further connected to a supplementary pump 1005. When the liquid is consumed by the liquid ejection head 2 performing an operation of ejecting or discharging the liquid from the ejection ports in the liquid ejection head 2, the supplementary pump 1005 transfers the consumed amount of ink from the main tank 1006 to the buffer tank 1003. Examples of the operation of ejecting or discharging the liquid include a recording operation, a suction recovery operation, and the like.

The negative pressure control unit 230 is provided on the flow path between the liquid ejection unit 300 and the negative pressure generating pump 1004, and communicates with the common collection channel 212. The negative pressure control unit 230 can employ a so-called "pressure reducing regulator", for example, as a pressure adjusting mechanism capable of controlling with a variation within a certain range centered on a desired set pressure, or less.

The liquid ejection unit 300 is provided with the common supply channel 211, the common collection channel 212, and an individual supply channel 213*a* and an individual collection channel 212, which communicate with each element substrate 10. An individual flow path 213 communicates with the common supply channel 211 and the common collection channel 212. The negative pressure generating pump 1004 functions as a negative pressure generating section that generates a negative pressure by reducing the pressure upstream of the negative pressure control unit 230, and also has a function to take the liquid from the liquid connection section 111 of the liquid ejection head 2 and allow the liquid to flow to the buffer tank 1003. As the negative pressure generating pump 1004, a turbo pump, a positive-displacement pump or the like can be used, as long as the pump has a certain lift pressure or more within a range of a circulation flow rate of the liquid used when driving the liquid ejection head 2. To be more specific, a diaphragm pump or the like is applicable as the negative pressure generating pump 1004. Alternatively, instead of the negative pressure generating pump 1004, a water head tank is also applicable, which is disposed to have a predetermined water head difference with respect to the water head of the negative pressure control unit 230, for example.

Inside the liquid supply unit 220, a filter 221 is provided to remove foreign objects in the liquid supplied.

Between the buffer tank 1003 and the liquid ejection head 2, an opening/closing valve 1020 is disposed to switch between the supply of the liquid and the suspension of the supply. In this embodiment, an NC (normal close) type solenoid valve is used as the opening/closing valve 1020, which is closed in a power-off state (normal state) where the liquid ejection apparatus 1000 is turned off. During normal circulation, the opening/closing valve 1020 is controlled to be opened.

The negative pressure control unit 230 is connected to the common collection channel 212 in the liquid ejection unit 300 through the liquid supply unit 220. Also, the buffer tank 1003 with the controlled water head is connected to the common supply channel 211 in the liquid ejection unit 300 through the opening/closing valve 1020 and the liquid supply unit 220.

By setting the pressure in the common supply channel 211 relatively higher than the pressure in the common collection channel 212, a flow is generated from the common supply channel 211 to the common collection channel 212 through an internal flow path in each element substrate 10 (arrows in FIG. 11).

Thus, heat generated in each element substrate 10 can be released to the outside of the element substrate 10 by the flow through the common supply channel 211 and the common collection channel 212. Also, when recording is performed with the liquid ejection head 2, a liquid flow can also be generated in the ejection ports or pressure chambers where no recording is performed, and thus thickening of the liquid in that area can be suppressed. Moreover, the thickened liquid and foreign objects in the liquid can be discharged to the common collection channel 212. This allows for high-speed and high-quality recording.

During normal circulation, the pressure in the common supply channel 211 is set to the water head (for example, −0.5 kPa) in the buffer tank 1003 by opening the opening/closing valve 1020. Also, the negative pressure control unit 230 controls the pressure in the common collection channel 212 to be a pressure (for example, −2.5 kPa) lower than the water head in the buffer tank 1003. This pressure difference allows the liquid to pass through the ejection ports 13 (pressure chambers 23) in the element substrate 10, and the pressure in the ejection ports 13 can be controlled to be a value (for example, −1.5 kPa) between the pressure in the common supply channel 211 and the pressure in the common collection channel 212. In this event, the negative pressure generating pump 1004 is controlled to be driven so that the pressure downstream of the negative pressure control unit 230 becomes a sufficient negative pressure (for example, 50 kPa) for the negative pressure control unit 230 to function normally.

(Description of Circulation Stop Procedure)

Figure 12:
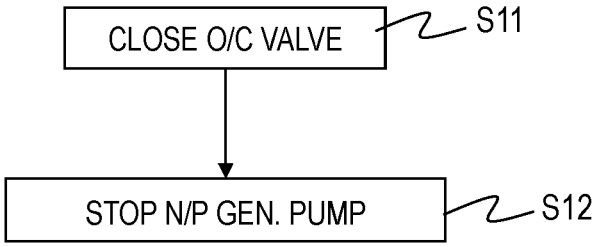
FIG. 12 is a flowchart showing a circulation stop operation according to the first embodiment of the present disclosure.

FIG. 12 is a flowchart for explaining a procedure for a circulation stop operation to stop the circulation (flow) of the liquid.

In the circulation stop operation, the circulation of the liquid (supply to the pressure chambers 23) is first stopped by closing the opening/closing valve 1020 that is the supply control section 401 (Step S11), and then the negative pressure generating pump 1004 is stopped (Step S12).

In other words, the negative pressure generating pump 1004 is stopped after the opening/closing valve 1020 is closed. Thus, the state where the negative pressure is applied to the downstream of the negative pressure control unit 230 is maintained even after the circulation of the liquid is stopped by closing the opening/closing valve 1020. As a result, the ejection ports 13 can be maintained in a state where the negative pressure is applied thereto. Therefore, leakage of the liquid from the ejection ports 13 can be reduced.

Figure 13:
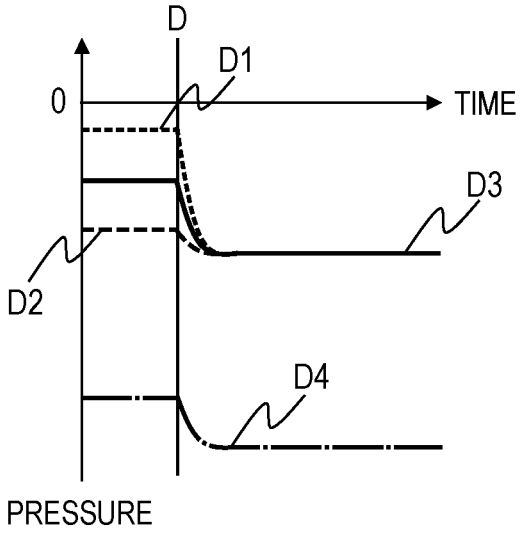
FIG. 13 is a diagram showing a pressure change according to the first embodiment of the present disclosure.

FIG. 13 is a conceptual diagram showing a pressure change in each spot of the flow path while the circulation is stopped. In FIG. 13, the horizontal axis represents time, while the vertical axis represents pressure. A vertically extending dotted line D represents a time point when the circulation stop operation is started (time point when the opening/closing valve 1020 is closed). A line D1 represents a pressure change on the upstream of the head, which is upstream of the liquid ejection head 2 and downstream of the opening/closing valve 1020, while a line D2 represents a pressure change on the downstream of the head, which is downstream of the liquid ejection head 2 and upstream of the negative pressure control unit 230. A line D3 represents a pressure change in the ejection ports 13, while a line D4 represents a pressure change downstream of the negative pressure control unit 230 and upstream of the negative pressure generating pump 1004.

As shown in FIG. 13, the negative pressure downstream of the negative pressure control unit 230 is increased by closing the opening/closing valve 1020, and the characteristics of the negative pressure control unit 230 also reduces the pressure downstream of the head. With no liquid supplied, the pressures in the ejection ports 13 and upstream of the head also become the same pressure downstream of the head in a certain period of time, and the flow of the liquid is stopped.

Figure 14:
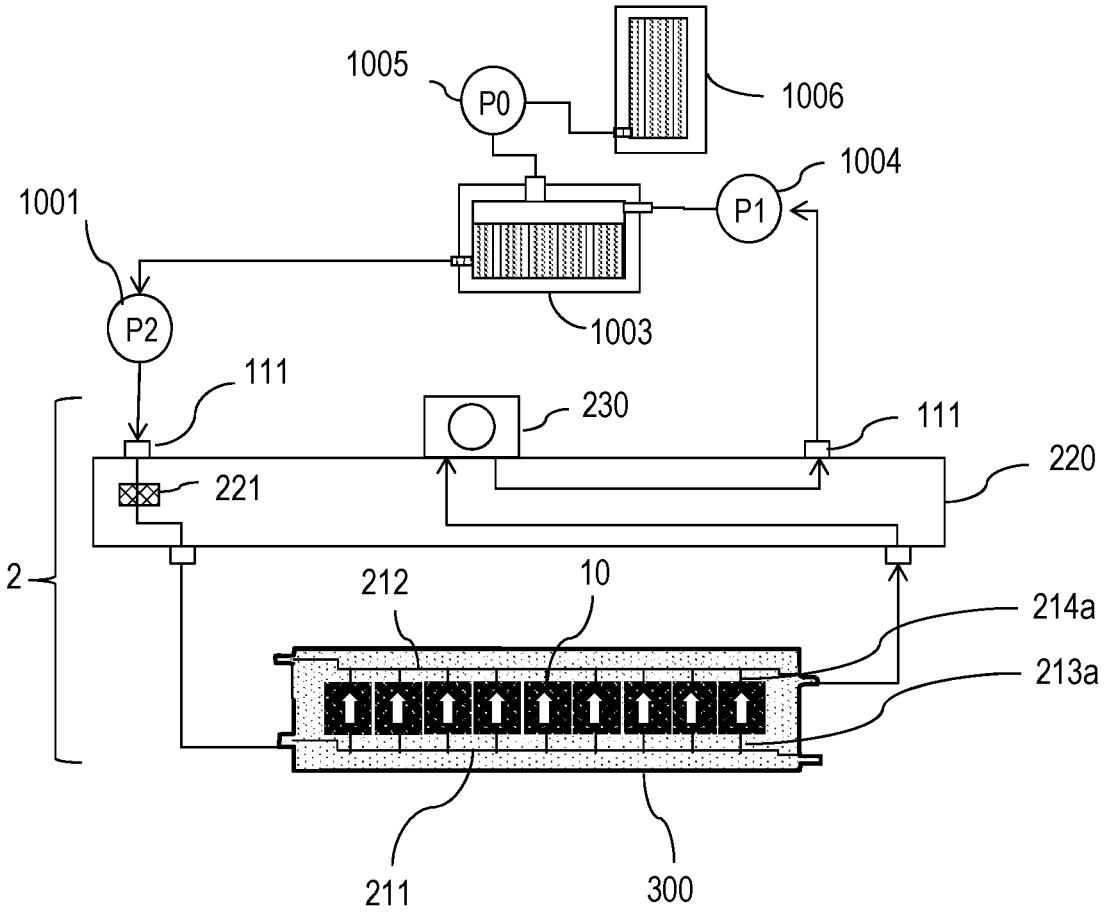
FIG. 14 is a schematic view showing a liquid circulation flow path according to a modified example of the first embodiment of the present disclosure.

FIG. 14 is a schematic diagram showing another example of the circulation flow path. The circulation flow path shown in FIG. 14 is different from the circulation flow path shown in FIG. 12 in using a circulation pump 1001 instead of the opening/closing valve 1020.

The circulation pump 1001 has a function to take the liquid from the liquid connection section 111 of the liquid ejection head 2 and allow the liquid to flow to the buffer tank 1003. As the circulation pump 1001, a positive-displacement pump capable of quantitatively sending the liquid is preferable. In this case, a circulation flow rate that is a flow rate of the liquid to be circulated can be controlled, eliminating the need for water head control in the buffer tank 1003. Thus, the degree of freedom of arrangement of the buffer tank 1003 can be improved.

In the example of FIG. 14, the pressure in the common supply channel 211 is determined according to the negative pressure obtained by the negative pressure control unit 230, flow path resistance of the liquid ejection unit 300, and the flow rate of the circulation pump 1001. Moreover, the circulation pump 1001 can stop the flow of the liquid when the drive thereof is stopped, and thus has the same function as that of the opening/closing valve 1020 shown in FIG. 12 when the circulation is stopped. A diaphragm pump or the like, for example, can be used as the circulation pump 1001.

As described above, according to this embodiment, to stop the circulation of the liquid, the supply of the liquid is stopped by the supply control section 401 (the opening/closing valve 1020 or the circulation pump 1001) and then the negative pressure control unit 230 is stopped. Thus, since the supply of the liquid is first stopped, the flow of the liquid can be stopped in a short period of time. Therefore, a cleaning liquid can be prevented from being mixed into the liquid even if a wiping operation is quickly started. Moreover, since the negative pressure generating section is stopped after the supply of the liquid is stopped, the downstream of the negative pressure control unit 230 can be maintained in a state where the negative pressure is applied thereto. Therefore, the ejection ports 13 can be maintained in a state where the negative pressure is applied thereto, when the fluid circulation is to be stopped. Accordingly, the flow of the liquid can be stopped in a short period of time while suppressing the leakage of the liquid from the ejection ports 13.

Second Embodiment

Figure 15:
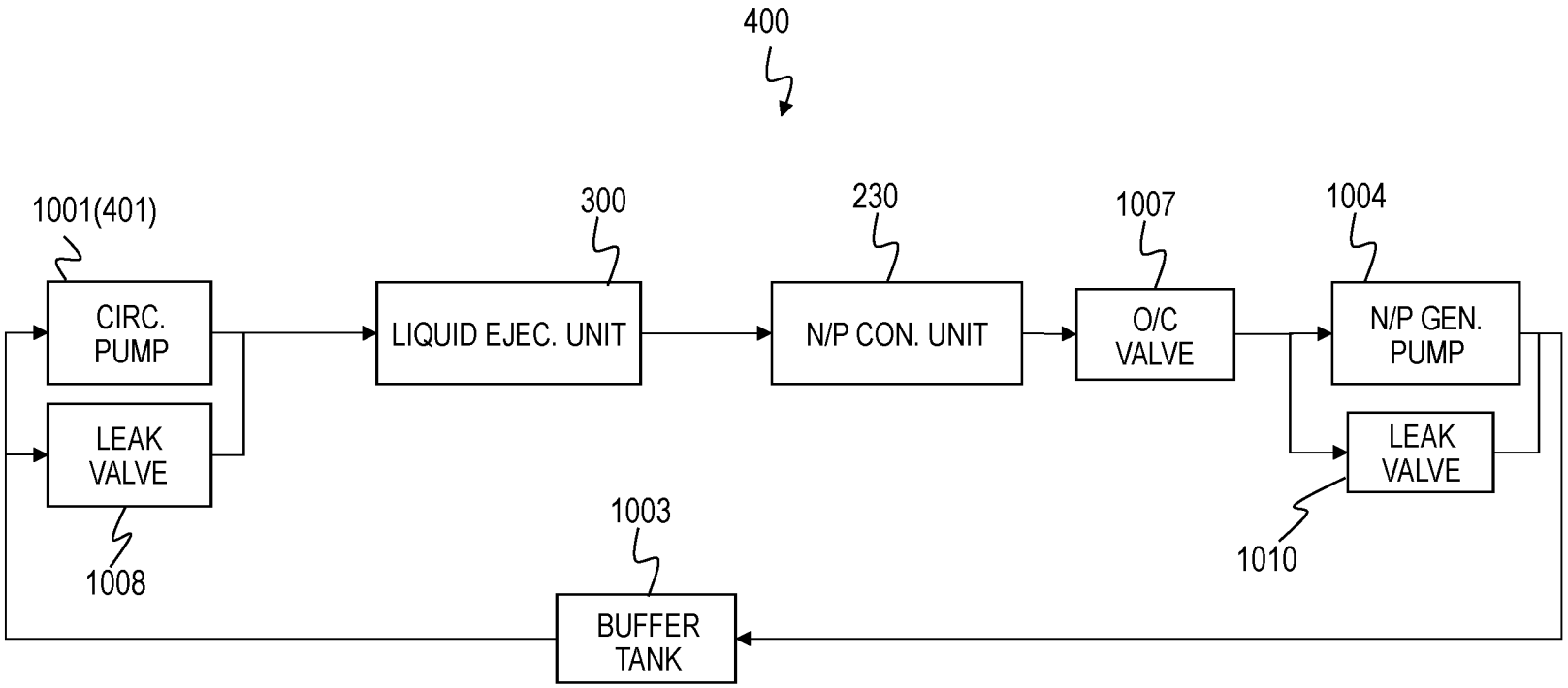
FIG. 15 is a block diagram showing a fluid circuit according to a second embodiment of the present disclosure.
Figure 16:
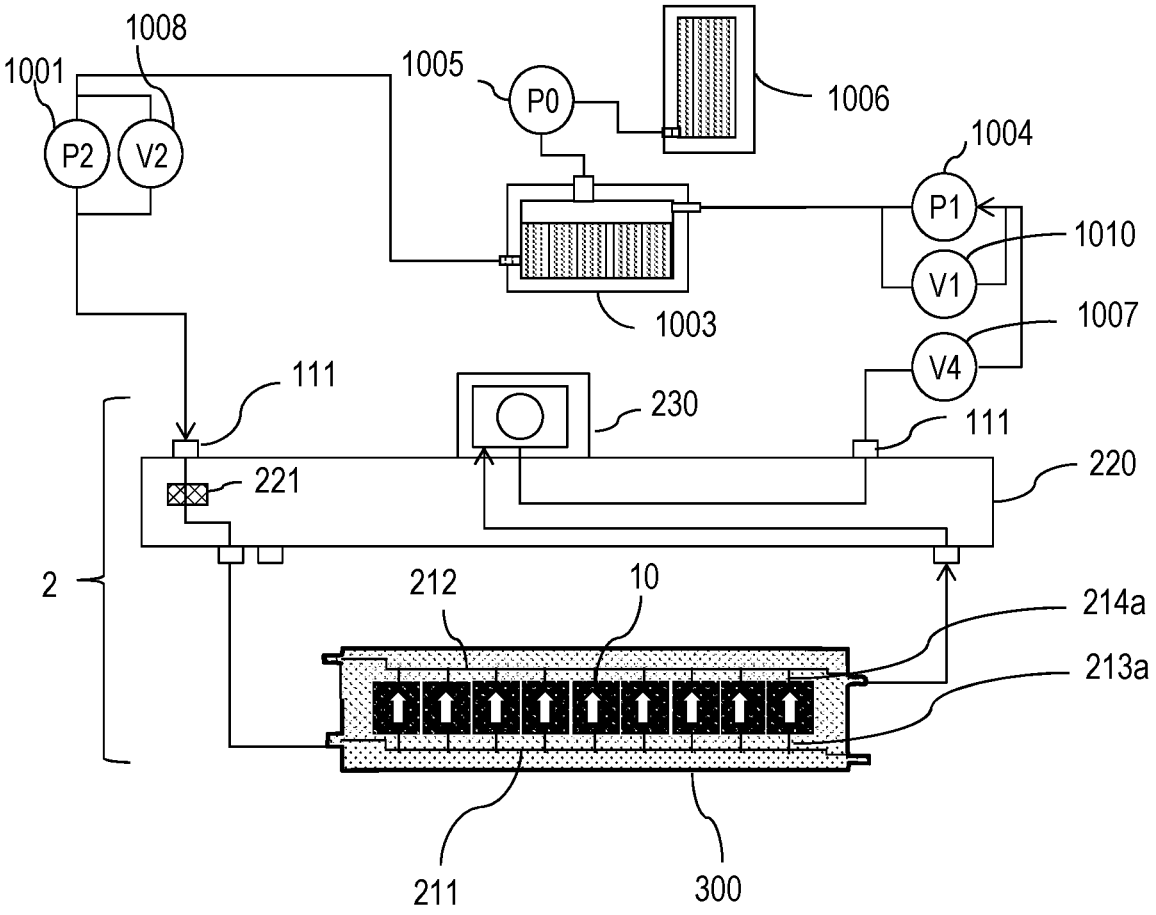
FIG. 16 is a schematic view showing a liquid circulation flow path according to the second embodiment of the present disclosure.

FIG. 15 is a block diagram showing a fluid circuit according to this embodiment. FIG. 16 is a schematic diagram showing a circulation flow path according to this embodiment.

As shown in FIGS. 15 and 16, a fluid circuit 400 includes a circulation pump 1001, as a supply control section 401, upstream of a liquid ejection unit 300, and a leak valve 1008 connected in parallel with the circulation pump 1001. The circulation pump 1001 and the leak valve 1008 communicate with a buffer tank 1003. The leak valve 1008 is a first pressure control valve to control the pressure by opening and closing. The leak valve 1008 is closed during circulation and opened when the circulation is stopped, thereby applying a water head in the buffer tank 1003 to the liquid ejection unit 300. The buffer tank 1003 is a storage container disposed at a position lower than the ejection ports 13 so as to obtain a water head for generating a negative pressure higher than a pressure set for the negative pressure control unit 230.

The negative pressure control unit 230 and a negative pressure generating pump 1004 are provided downstream of the liquid ejection unit 300. An opening/closing valve 1007 is provided between the negative pressure control unit 230 and the negative pressure generating pump 1004. The opening/closing valve 1007 is a flow path opening/closing valve to control the flow and stop of the liquid. The fluid circuit 400 includes a leak valve 1010 connected in parallel with the negative pressure generating pump 1004. The leak valve 1010 is a second pressure control valve to control the pressure by opening and closing. The negative pressure generating pump 1004 and the leak valve 1010 communicate with an air layer in the buffer tank 1003. The leak valve 1010 is closed during circulation and opened when the circulation is stopped (when the negative pressure generating pump 1004 is stopped). Thus, a residual negative pressure between the negative pressure control unit 230 and the negative pressure generating pump 1004 can be released to the air layer in the buffer tank 1003.

In the above configuration, during circulation, the leak valves 1008 and 1010 are closed and the opening/closing valve 1007 is opened. The circulation pump 1001 controls a circulation flow rate that is a flow rate of the liquid to be circulated, while supplying the liquid to the common supply channel 211. The negative pressure control unit 230 uses a negative pressure generated by the negative pressure generating pump 1004 to control the negative pressure in the common collection channel 212, thereby maintaining the negative pressure in the ejection ports 13 within a certain range.

(Description of Circulation Stop Procedure)

Figure 17:
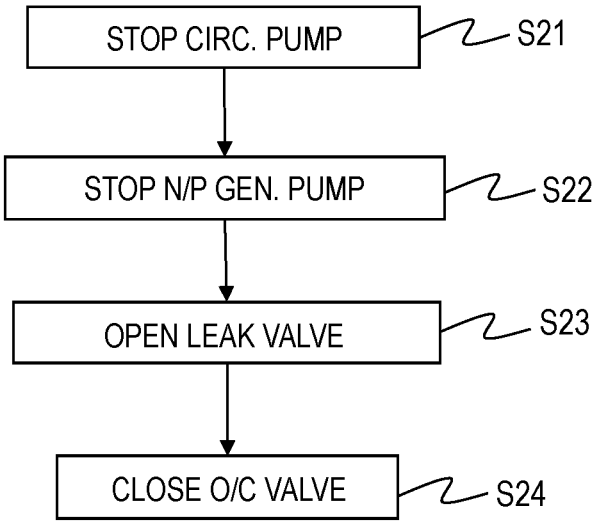
FIG. 17 is a flowchart for explaining a circulation stop operation according to the second embodiment of the present disclosure.

FIG. 17 is a flowchart for explaining a procedure for a circulation stop operation according to this embodiment. In the circulation stop operation, the circulation of the liquid (supply to the liquid ejection unit 300) is first stopped by stopping the circulation pump 1001 (Step S21), and then the negative pressure generating pump 1004 is stopped (Step S22). Thus, leakage of the liquid from the ejection ports 13 can be reduced as in the case of the first embodiment. In this embodiment, the leak valves 1008 and 1010 are further opened to release the pressures downstream of the circulation pump 1001 and upstream of the negative pressure generating pump 1004 to the water head in the buffer tank 1003 (Step S23). Then, the flow of the liquid is completely stopped by closing the opening/closing valve 1007 (Step S24).

By performing the circulation stop operation as described above, the negative pressure (water head) in the buffer tank 1003 can be applied to the liquid ejection head 2, and the ejection ports 13 can be maintained in a state where the negative pressure is applied thereto. Moreover, the residual negative pressure generated by the negative pressure generating pump 1004 is released by the leak valve 1010 while stopping the flow of the liquid with the opening/closing valve 1007. Thus, load on the circulation flow path can be reduced.

Figure 18:
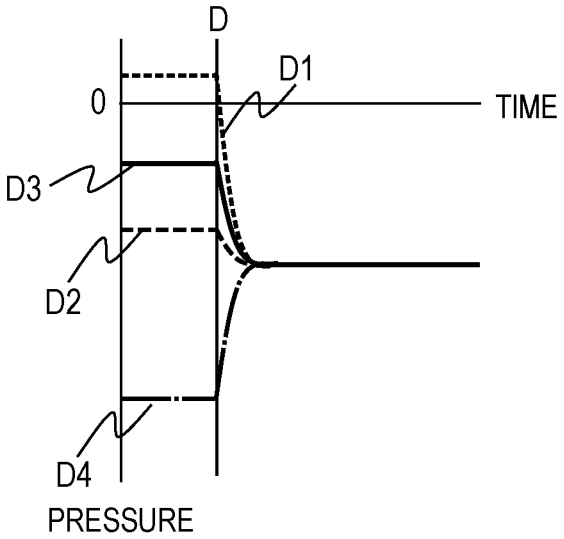
FIG. 18 is a diagram showing a pressure change according to the second embodiment of the present disclosure.

FIG. 18 is a conceptual diagram showing a pressure change in each spot of the flow path when the circulation is stopped. As shown in FIG. 18, when the circulation stop operation is started and the leak valves 1008 and 1010 are opened, the pressure in each spot quickly changes to the negative pressure in the buffer tank 1003. Therefore, the flow of the liquid can be stopped in a short period of time.

Third Embodiment

Figure 19:
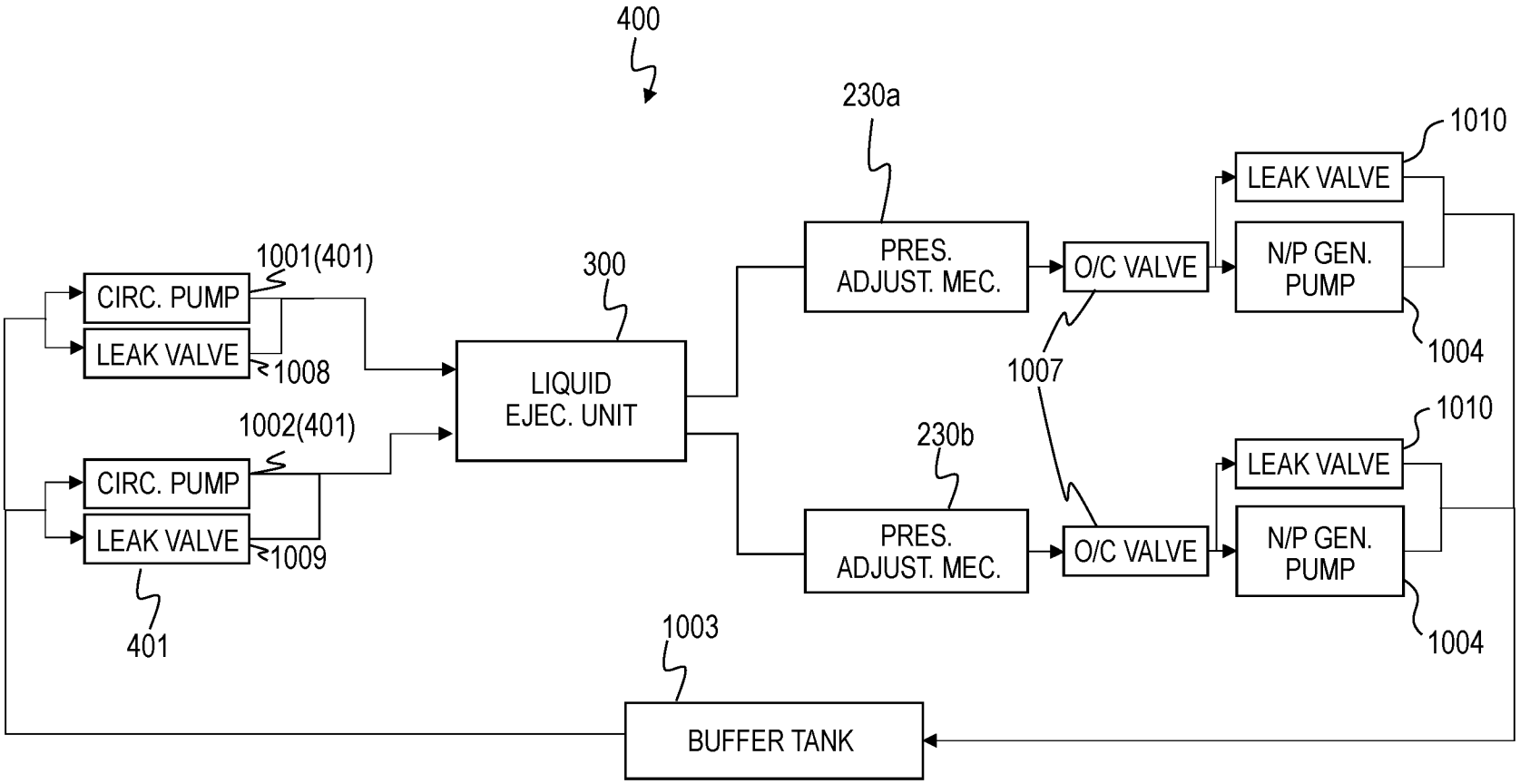
FIG. 19 is a block diagram showing a fluid circuit according to a third embodiment of the present disclosure.
Figure 20:
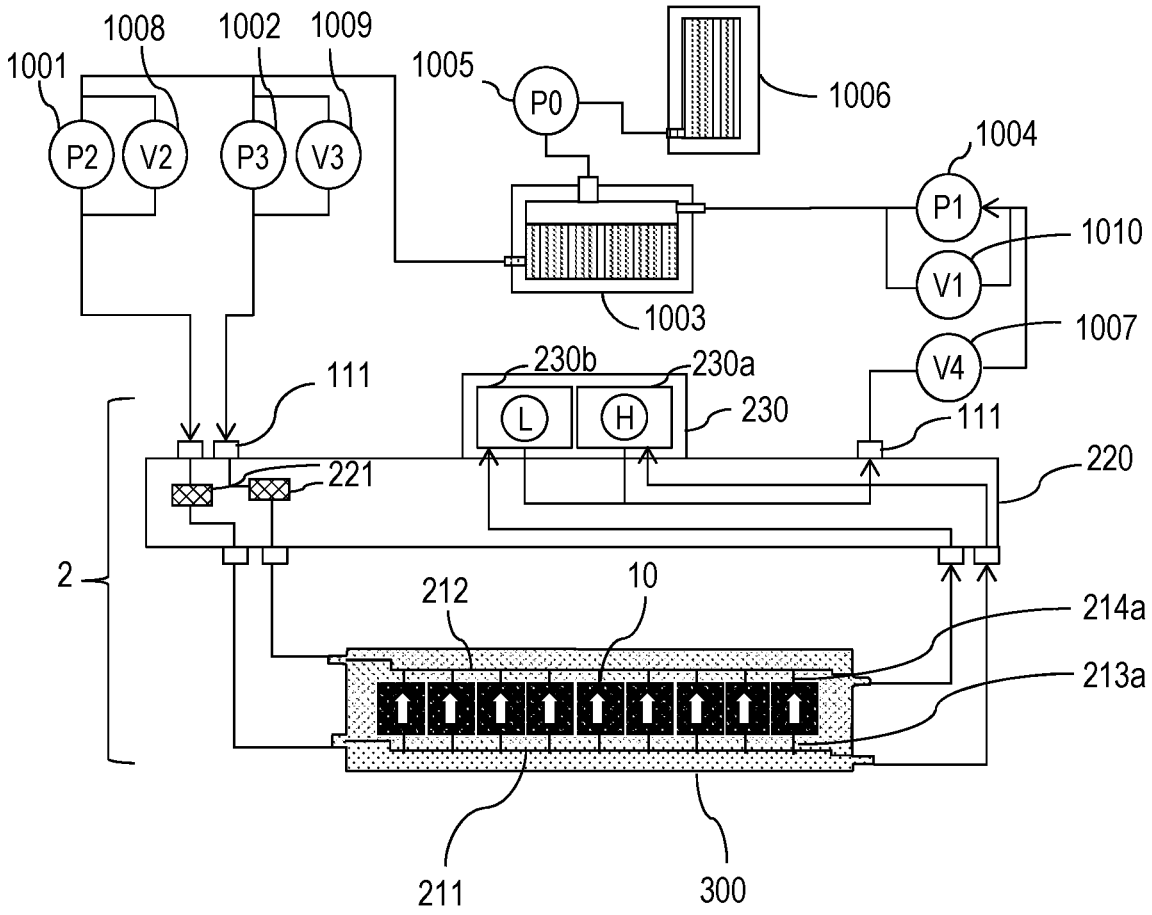
FIG. 20 is a schematic view showing a liquid circulation flow path according to the third embodiment of the present disclosure.

FIG. 19 is a block diagram showing a fluid circuit according to this embodiment. FIG. 20 is a schematic diagram showing a circulation flow path according to this embodiment.

A fluid circuit 400 shown in FIGS. 19 and 20 is different from the fluid circuit 400 according to the second embodiment shown in FIGS. 15 and 16 in including supply control sections 401 for both of a common supply channel 211 and a common collection channel 212. To be more specific, in addition to a circulation pump 1001 and a leak valve 1008, which communicate with the common supply channel 211, a circulation pump 1002 and a leak valve 1009 are provided, which communicate with the common collection channel 212. The circulation pump 1002 and the leak valve 1009 are connected in parallel with each other. The fluid circuit 400 also includes two pressure adjusting mechanisms 230*a* and 230*b* communicating with the common supply channel 211 and the common collection channel 212, respectively, as a negative pressure control unit 230.

With the above configuration, the pressure in the common supply channel 211 can also be controlled by the negative pressure control unit 230. Moreover, the supply of the liquid to the liquid ejection unit 300 can also be performed from the common collection channel 212. Thus, even the liquid ejection head 2 with high ejection amount, such as a wide-page type, can be prevented from lacking the liquid to be ejected.

Note that the configuration of the flow path member (negative pressure generating pump 1004, opening/closing valve 1007, and leak valve 1008) downstream of the negative pressure control unit 230 may be any of those shown in FIGS. 19 and 20. In other words, the downstream flow path member may be provided individually for the common supply channel 211 and the common collection channel 212 as shown in FIG. 19, or may be provided in common for the common supply channel 211 and the common collection channel 212 as shown in FIG. 20.

The negative pressure control unit 230 is configured such that the pressure in the pressure adjusting mechanism 230*a* connected to the common supply channel 211 is higher than the pressure in the pressure adjusting mechanism 230*b* connected to the common collection channel 212. The liquid is circulated by a difference in pressure therebetween.

In the example of FIGS. 19 and 20, the common supply channel 211 and the common collection channel 212 extend in the longitudinal direction of the liquid ejection head 2, and the liquids flowing through the common supply channel 211 and the common collection channel 212 flow in the same direction. However, it is preferable that the pressure adjusting mechanisms 230*a* and 230*b* are disposed at both ends of the liquid ejection head (liquid supply unit 220) and the liquids flowing through the common supply channel 211 and the common collection channel 212 flow in opposite directions. In this case, heat exchange is facilitated between the common supply channel 211 and the common collection channel 212, thus making it possible to reduce temperature differences among the plurality of element substrates 10 provided along the common supply channel 211. Therefore, non-uniform recording due to temperature differences among the element substrates 10 can be reduced.

As in the case of the second embodiment, leak valves 1008, 1009, and 1010 are connected in parallel with the circulation pumps 1001 and 1002 and the negative pressure generating pump 1004. In this embodiment, as the leak valves 1008, 1009, and 1010, NO (normal open) type solenoid valves are used, which are opened in a power-off state. The leak valves 1008, 1009, and 1010 are controlled to be closed during normal circulation. Also, an NC type solenoid valve is used as the opening/closing valve 1007. During normal circulation, the opening/closing valve 1007 is controlled to be opened.

A procedure for a circulation stop operation is the same as that of the second embodiment described with reference to FIG. 17, and a pressure change in each spot of the flow path when the circulation is stopped is the same as that of the embodiment shown in FIG. 18. In the case of this embodiment, the flow of the liquid can be stopped in a short period of time even if the liquid flows in large quantities.

Fourth Embodiment (Description of Liquid Ejection Apparatus)

Figure 21:
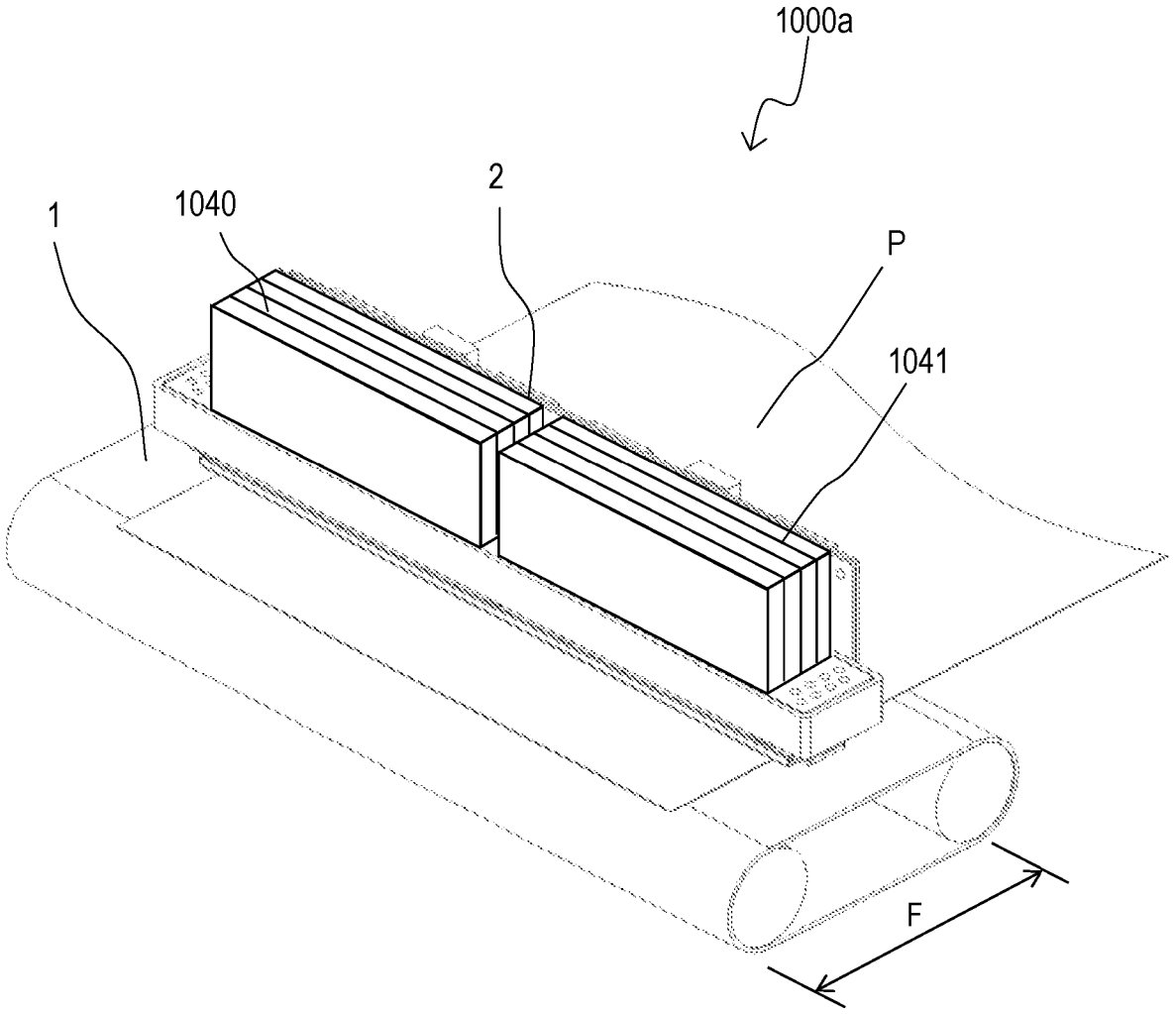
FIG. 21 is a perspective view schematically showing a liquid ejection apparatus according to a fourth embodiment of the present disclosure.

FIG. 21 is a perspective view schematically showing a liquid ejection apparatus according to a fourth embodiment of the present disclosure. A liquid ejection apparatus 1000*a* shown in FIG. 21 is a page-wide type as in the case of the liquid ejection apparatus 1000 shown in FIG. 1, but is different in configuration of a liquid ejection head. A liquid ejection unit 2 of this embodiment can perform full-color printing using C, M, Y, and K (cyan, magenta, yellow, and black) inks as liquids. Moreover, the liquid ejection apparatus 1000*a* includes a pressure reducing valve 1040 and a back pressure valve 1041, which function as a negative pressure control unit 230.

(Description of Circulation Flow Path)

Figure 22:
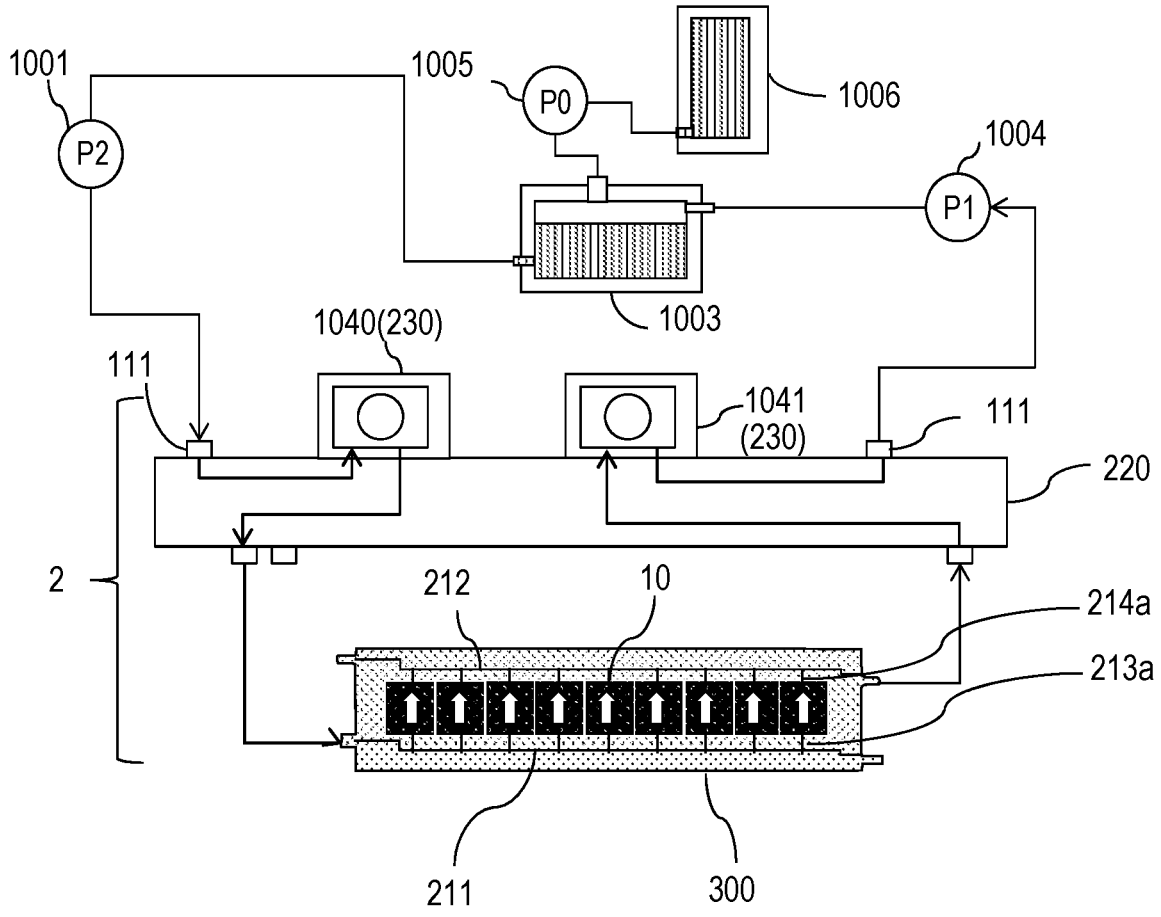
FIG. 22 is a schematic view showing a liquid circulation flow path according to the fourth embodiment of the present disclosure.

FIG. 22 is a schematic diagram showing a circulation flow path according to this embodiment. The circulation flow path shown in FIG. 22 is different from the circulation flow path according to the modified example of the first embodiment shown in FIG. 14 in including the pressure reducing valve 1040 and the back pressure valve 1041 as the negative pressure control unit 230. Note that, to simplify the illustration, FIG. 22 only shows a flow path through which a liquid of one of the four colors, C, M, Y, and K flows. However, circulation flow paths for the four colors are actually provided in the liquid ejection unit 2 and the main body of the liquid ejection apparatus 1000.

The pressure reducing valve 1040 is provided on a flow path between a circulation pump 1001 and a liquid ejection unit 300, while the back pressure valve 1041 is provided on a flow path between the liquid ejection unit 300 and a negative pressure generating pump 1004.

The pressure reducing valve 1040 is supplied with a liquid from a buffer tank 1003 through a liquid connection section 111 by the circulation pump 1001. The pressure reducing valve 1040 is connected to a common supply channel 211 and opened when the pressure in the common supply channel 211 is increased, and operates so as to maintain the pressure in the common supply channel 211 at a set pressure.

The back pressure valve 1041 is connected to the common collection channel 212. The back pressure valve 1041 has a negative pressure applied thereto by the negative pressure generating pump 1004, and operates so as to maintain the pressure in the common collection channel 212 at a set pressure.

Since the pressure reducing valve 1040 is connected to the common supply channel 211 and the back pressure valve 1041 is connected to the common collection channel 212, a pressure difference is generated between the common supply channel 211 and the common collection channel 212. Thus, some of the liquid flows from the common supply channel 211 to the common collection channel 212 through an internal flow path in the element substrate 10. As a result, in the liquid ejection unit 300, a flow is generated that passes through each element substrate 10 in the common supply channel 211 and the common collection channel 212.

(Description of Liquid Ejection Head Configuration)

Figure 23:
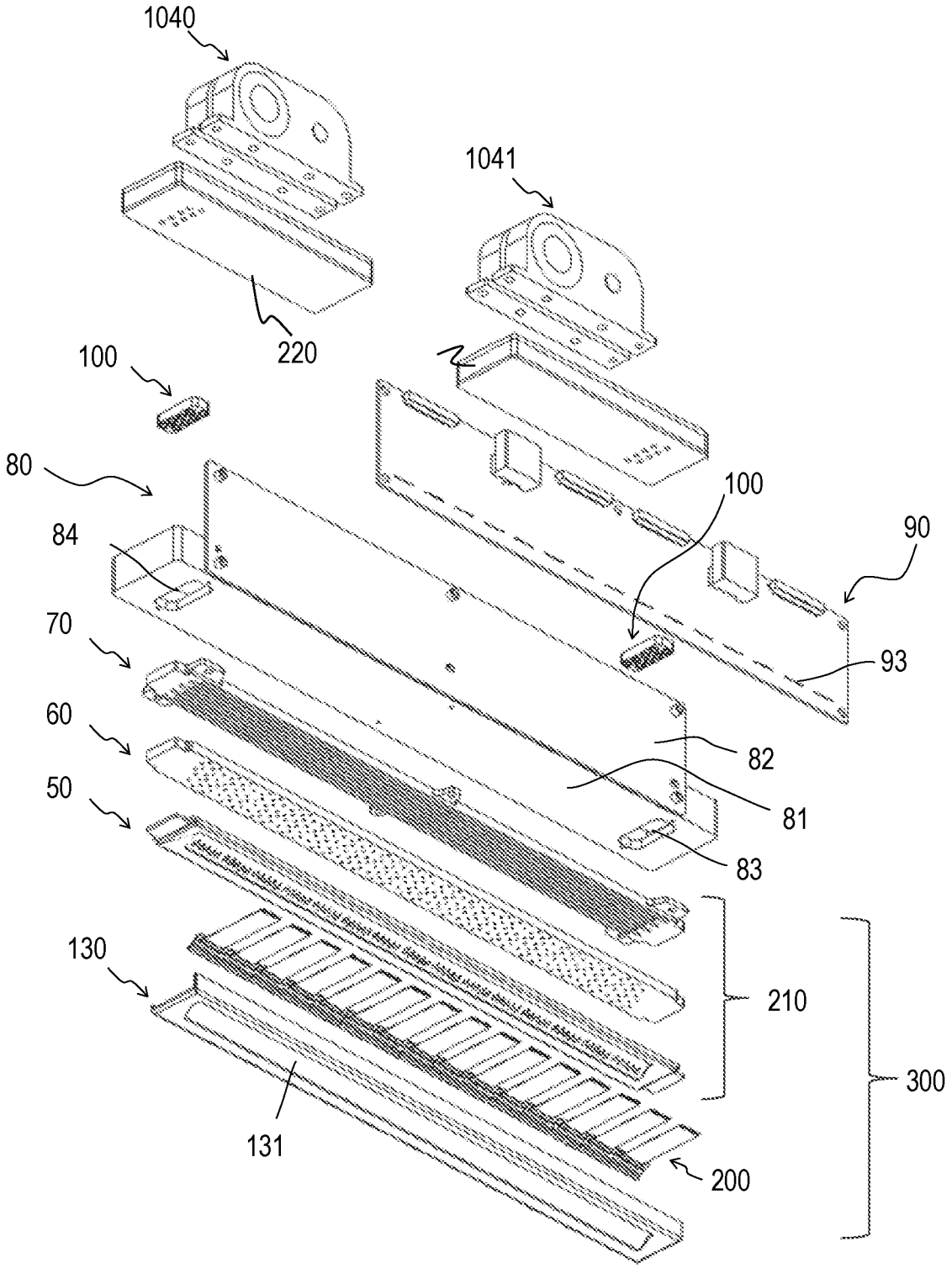
FIG. 23 is an exploded perspective view showing a liquid ejection head according to the fourth embodiment of the present disclosure.

FIG. 23 is an exploded perspective view showing respective parts or units included in the liquid ejection head 2. In the liquid ejection head 2 shown in FIG. 23, the liquid ejection unit 300, a liquid supply unit 220, and an electrical circuit board 90 are attached to a housing 80. The liquid supply unit 220 includes sub-tanks (buffer tanks 1003) for four colors. As shown in FIG. 21, the pressure reducing valve 1040 communicates with the common supply channel 211 in the liquid ejection unit 300, while the back pressure valve 1041 communicates with the common collection channel 212.

The housing 80 includes a liquid ejection unit supporting section 81 and an electrical circuit board supporting section 82 to support the liquid ejection unit 300 and the electrical circuit board 90, and also secures the rigidity of the liquid ejection head 2. The electrical circuit board supporting section 82 is a member to support the electrical circuit board 90, and is screwed to the liquid ejection unit supporting section 81. The liquid ejection unit supporting section 81 serves to correct warpage or deformation of the liquid ejection unit 300 and secure relative positional accuracy for the plurality of element substrates 10, thereby suppressing stripes and unevenness on a recorded article. Therefore, the liquid ejection unit supporting section 81 preferably has sufficient rigidity, and a metal material such as SUS and aluminum or ceramic such as alumina is suitable for the material thereof. The liquid ejection unit supporting section 81 has openings 83 and 84 provided therein, into which joint rubbers 100 are inserted. The liquid supplied from the liquid supply unit 220 is guided to a third flow path member 70 included in the liquid ejection unit 300 through the joint rubbers. The liquid ejection unit 300 includes a plurality of ejection modules 200 and a flow path member 210, and has a cover member 130 attached to a surface thereof on the recording medium side.

Next, description is given of a configuration of the flow path member 210 included in the liquid ejection unit 300. As shown in FIG. 23, the flow path member 210 is formed by laminating a first flow path member 50, a second flow path member 60, and a third flow path member 70. As in the case of the flow path member 210 in the first embodiment, the flow path member 210 distributes the liquid supplied from the liquid supply units 220 to the respective ejection modules 200, and returns the liquid returning from the ejection modules 200 to the liquid supply units 220. The flow path member 210 is screwed to the liquid ejection unit supporting section 81, thereby suppressing warpage or deformation of the flow path member 210.

Figure 24A:
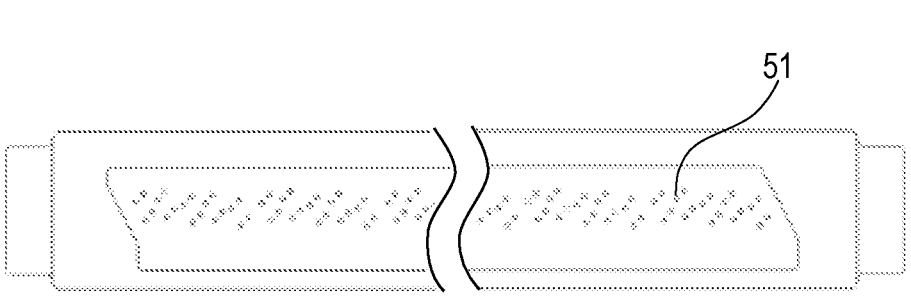
FIGS. 24A, 24B, 24C, 24D, 24E and 24F are plan views showing a flow path member according to the fourth embodiment of the present disclosure.
Figure 24B:
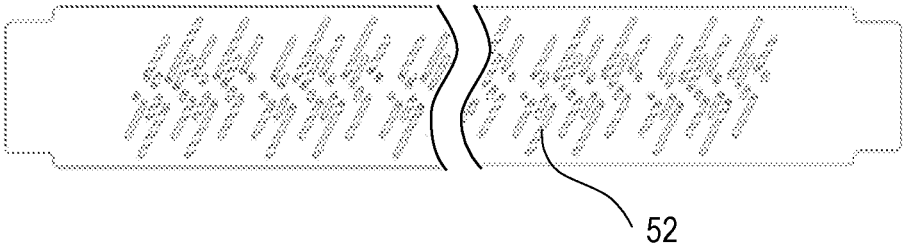
Figure 24C:
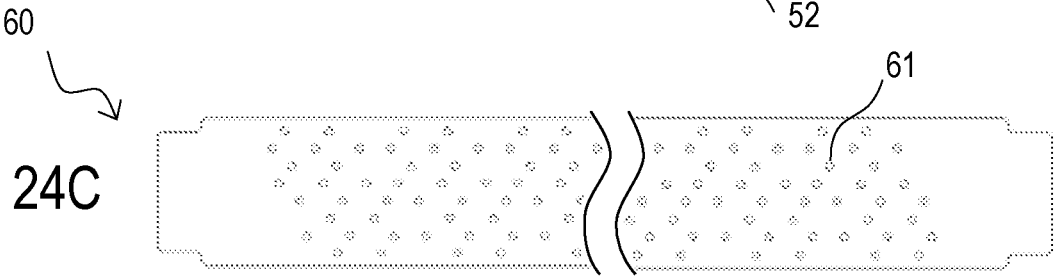
Figure 24D:
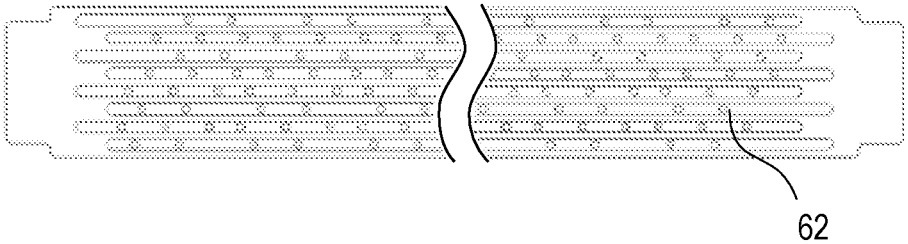
Figure 24E:
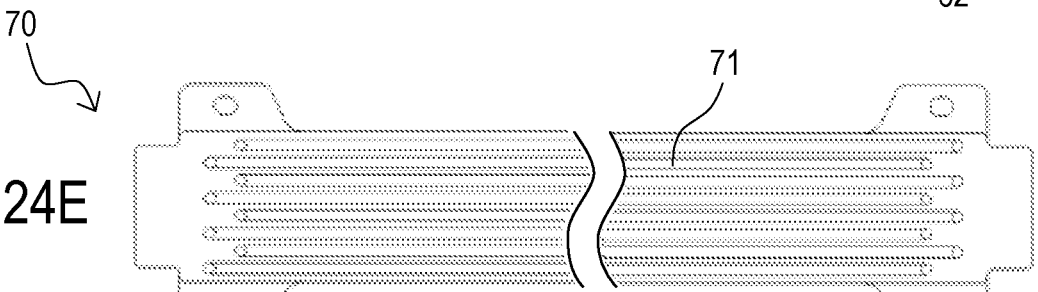
Figure 24F:
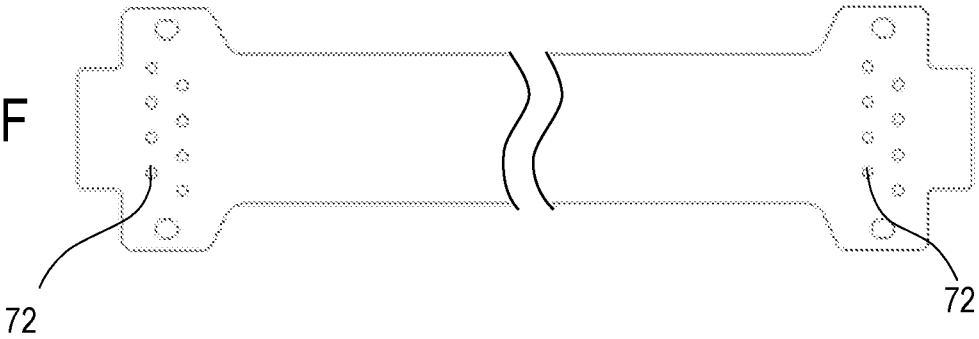

FIGS. 24A to 24F are diagrams showing front and back surfaces of each of the first to third flow path members. FIG. 24A shows a surface of the first flow path member 50 where the ejection modules 200 are mounted, while FIG. 24F shows a surface of the third flow path member 70 on the side abutting against the liquid ejection unit supporting section 81. The first and second flow path members 50 and 60 are joined together such that the abutting surfaces shown in FIGS. 24B and 24C face each other, while the second and third flow path members are joined together such that the abutting surfaces shown in FIGS. 24D and 24E face each other. When the second and third flow path members 60 and 70 are joined together, common flow channels 62 and 71 formed in the second and third flow path members 60 and 70 form eight common flow paths extending in the longitudinal direction of the flow path member. Thus, the common supply channel 211 and the common collection channel 212 are formed in set for each color in the flow path member 210. The third flow path member 70 has communication ports 72 communicating with the respective holes for the joint rubbers 100 and communicating with the liquid supply units 220 in a fluid-flowable manner. A bottom surface of the common flow channel 62 in the second flow path member 60 has a plurality of communication ports 61 formed therein, which communicate with one ends of individual flow channels 52 in the first flow path member 50. Also, the first flow path member 50 has communication ports 51 formed at the other ends of the individual flow channels 52, and communicates with the plurality of ejection modules 200 through the communication ports 51 in a fluid-flowable manner. The individual flow channels 52 allow for aggregation of the flow paths toward the center of the flow path member.

It is preferable that the first to third flow path members 50 to 70 are anticorrosive to the liquid and are formed of a material having a low linear expansion coefficient. A suitable material for the first to third flow path members 50 to 70 is, for example, a composite material (resin material) obtained by adding an inorganic filler to a base material such as alumina, LCP (liquid crystal polymer), PPS (polyphenylene sulfide) or PSF (polysulfone). Examples of the inorganic filler include silica microparticles, fibers and the like. As for a method for forming the flow path member 210, the three flow path members may be laminated and attached to each other, or a method for joining the members by welding may be used when a composite resin material is selected as the material.

Figure 25:
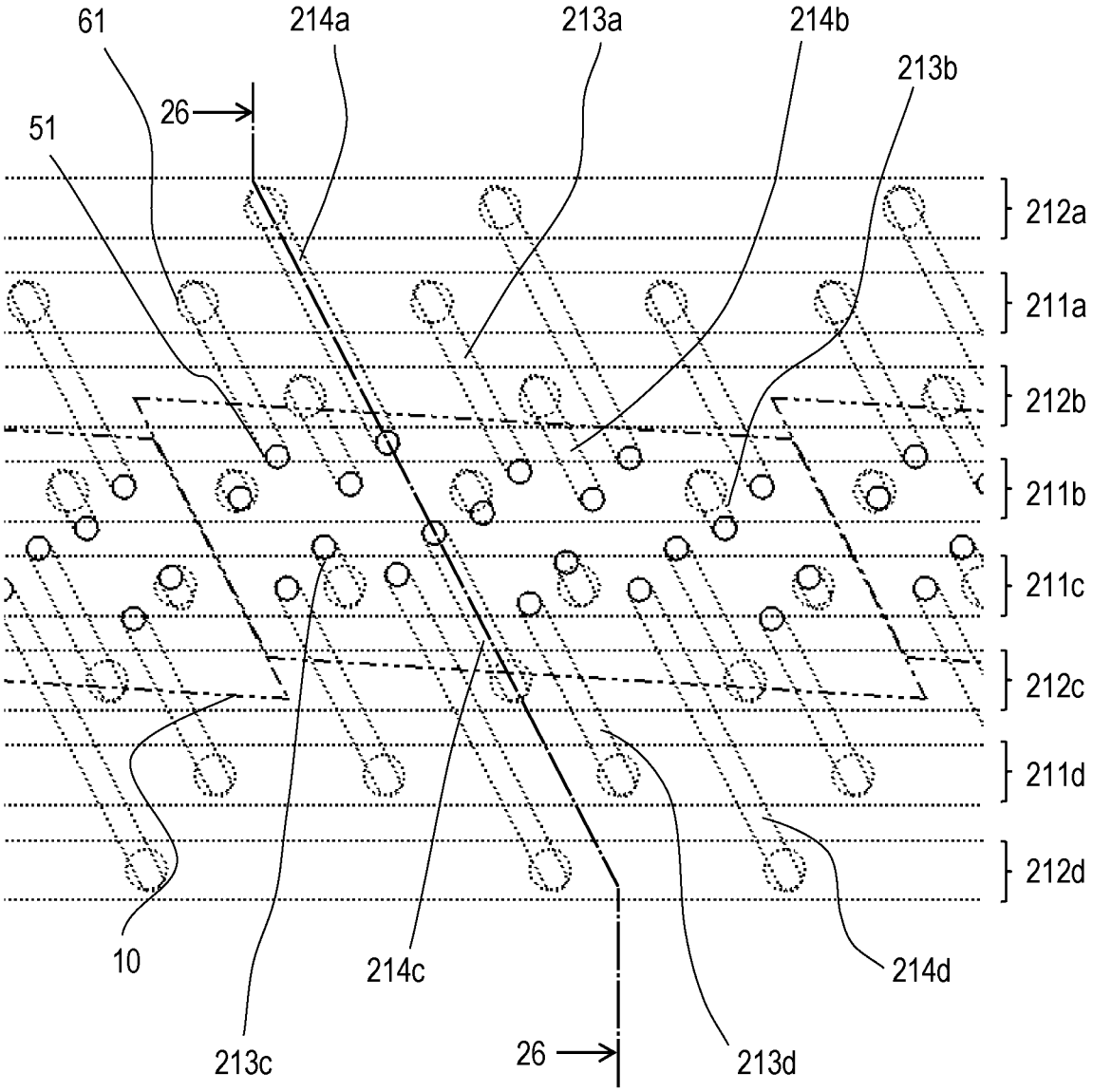
FIG. 25 is a perspective view showing a flow path member according to the fourth embodiment of the present disclosure.

Next, with reference to FIG. 25, description is given of a connection relationship between flow paths in the flow path member 210. FIG. 25 is an enlarged perspective view showing some of the flow paths in the flow path member 210 formed by joining the first to third flow path members, as seen from the surface of the first flow path member 50 where the ejection modules 200 are mounted. In the flow path member 210, common supply channels 211 (211*a*, 211*b*, 211*c*, and 211*d*) and common collection channels 212 (212*a*, 212*b*, 212*c*, and 212*d*) extending in the longitudinal direction of the liquid ejection unit 2 are provided for each color. A plurality of individual supply channels (213*a*, 213*b*, 213*c*, and 213*d*) formed by the individual flow channels 52 are connected to the common supply channels 211 of each color through communication ports 61. Also, a plurality of individual collection channels (214*a*, 214*b*, 214*c*, and 214*d*) formed by the individual flow channels 52 are connected to the common collection channels 212 of each color through communication ports 61. With such a flow path configuration, the liquid can be aggregated from the common supply channels 211 to the element substrate 10 positioned in the center of the flow path member through the individual supply channels 213. Moreover, the liquid can be collected from the element substrates 10 to the respective common collection channels 212 through the individual collection channels 214.

Figure 26:
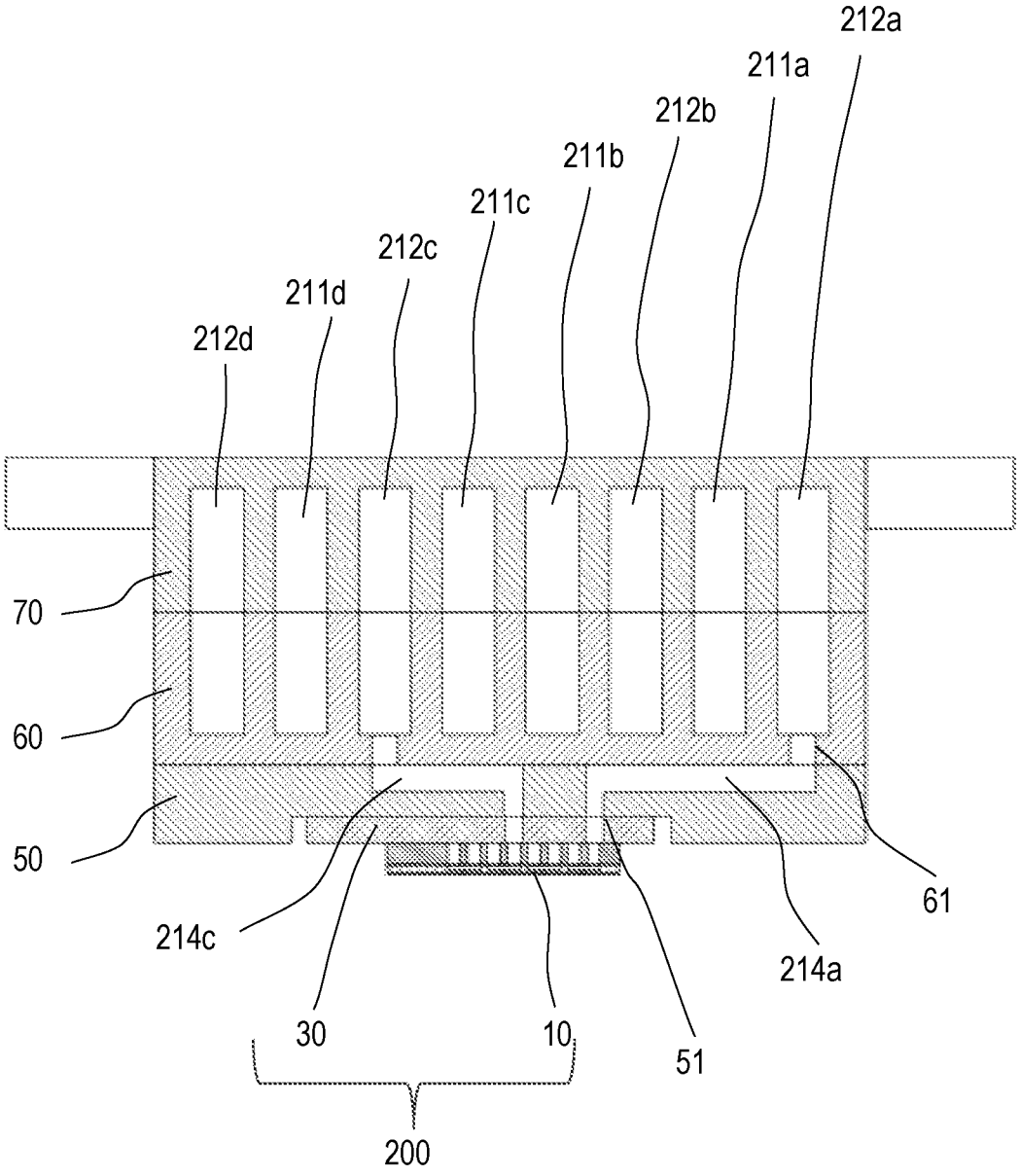
FIG. 26 is a cross-sectional view showing the flow path member according to the fourth embodiment of the present disclosure.

FIG. 26 is a cross-sectional view taken along the line 26-26 in FIG. 25. As shown in FIG. 26, the individual collection channels 214*a* and 214*c* are in communication with the ejection module 200 through the communication ports 51. Although FIG. 26 only illustrates the individual collection channels 214*a* and 214*c*, the individual supply channels 213 communicate with the ejection module 200 in another cross-section, as shown in FIG. 25. In the supporting member 30 and the element substrate 10 included in each ejection module 200, flow paths are formed to supply the liquid from the first flow path member 50 to recording elements 15 provided in the element substrate 10. Moreover, in the supporting member 30 and the element substrate 10 included in each ejection module 200, flow paths are formed to collect (return) some of or all of the liquid supplied to the recording elements 15 to the first flow path member 50. Here, the common supply channels 211 for each color are connected to a pressure reducing valve 1040 of the corresponding color through the liquid supply unit 220, while the common collection channels 212 are connected to a back pressure valve 1041 through the liquid supply unit 220. The pressure reducing valve 1040 and the back pressure valve 1041 generate a differential pressure (pressure difference) between the common supply channel 211 and the common collection channel 212. Thus, in the liquid ejection unit 2 shown in FIGS. 25 and 26, a flow is generated that flows from the common supply channel 211 to the common collection channel 212 sequentially through the individual supply channel 213*a*, the element substrate 10, and the individual collection channel 214*a* for each color.

(Description of Ejection Module)

Figure 27A:
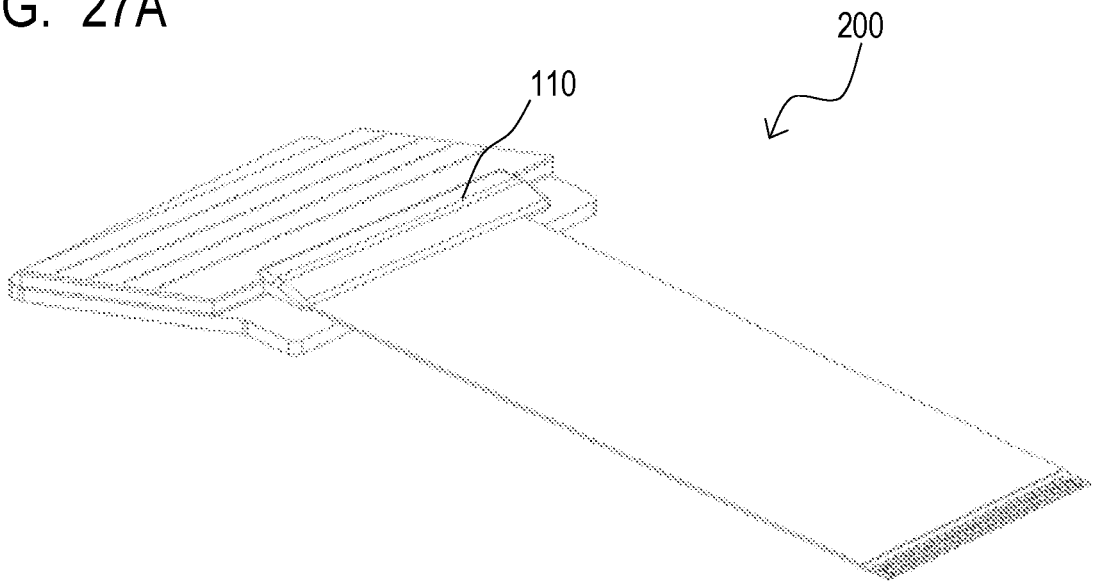
FIGS. 27A and 27B are diagrams showing an ejection module according to the fourth embodiment of the present disclosure.
Figure 27B:
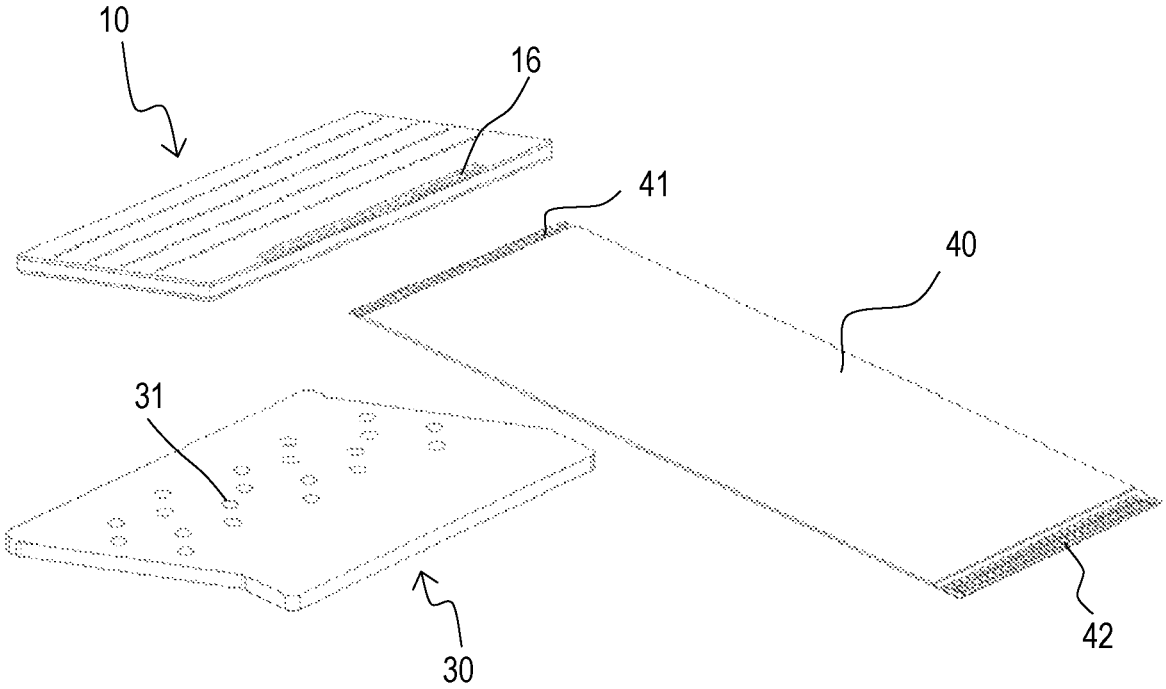

FIG. 27A is a perspective view of one of the ejection modules 200, while FIG. 27B is an exploded view thereof. A method for manufacturing the ejection module 200 is the same as the method for manufacturing the ejection module 200 according to the first embodiment shown in FIGS. 7A and 7B. In the example of FIGS. 27A and 27B, a plurality of terminals 16 are disposed on a one-side section along the direction of a plurality of ejection port arrays in the element substrate 10. Thus, for one element substrate 10, only one flexible wiring board 40 is electrically connected to the terminals 16.

(Description of Structure of Element Substrate)

Figure 28A:
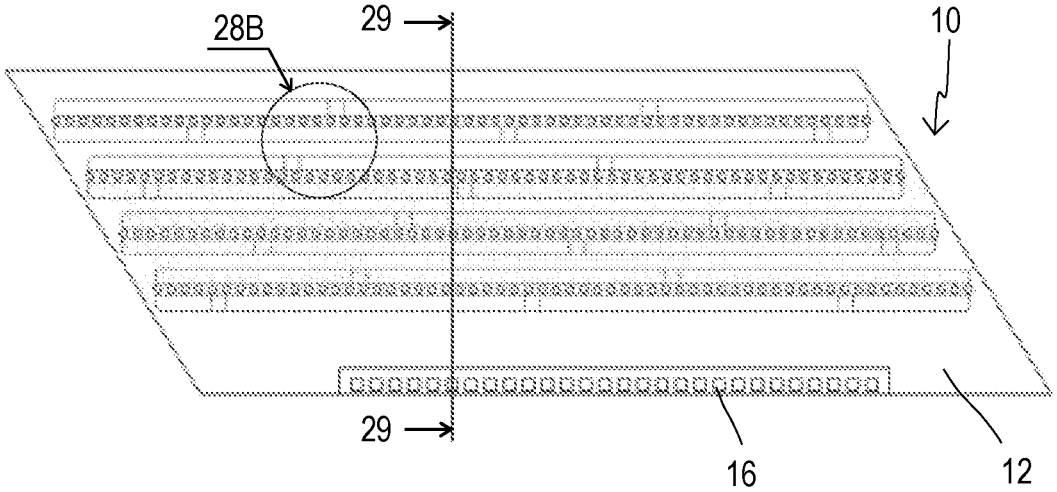
FIGS. 28A, 28B and 28C are plan views showing an element substrate according to the fourth embodiment of the present disclosure.
Figure 28B:
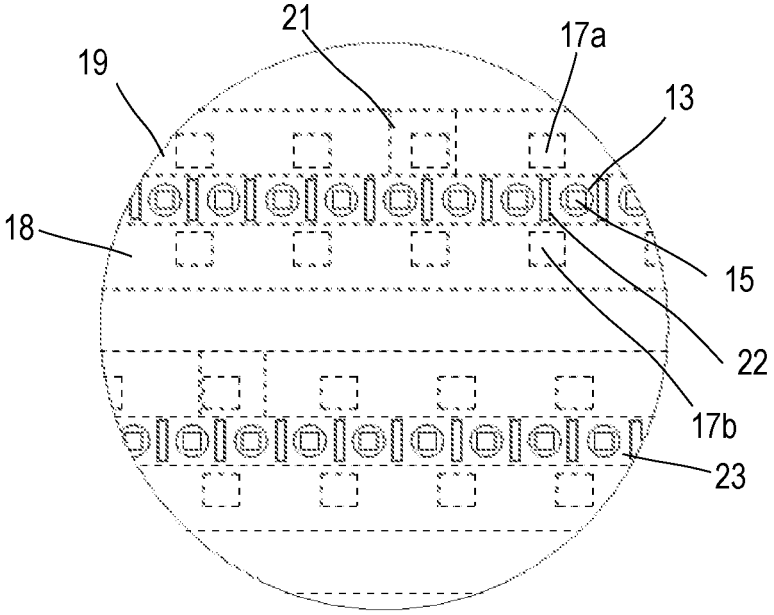
Figure 28C:
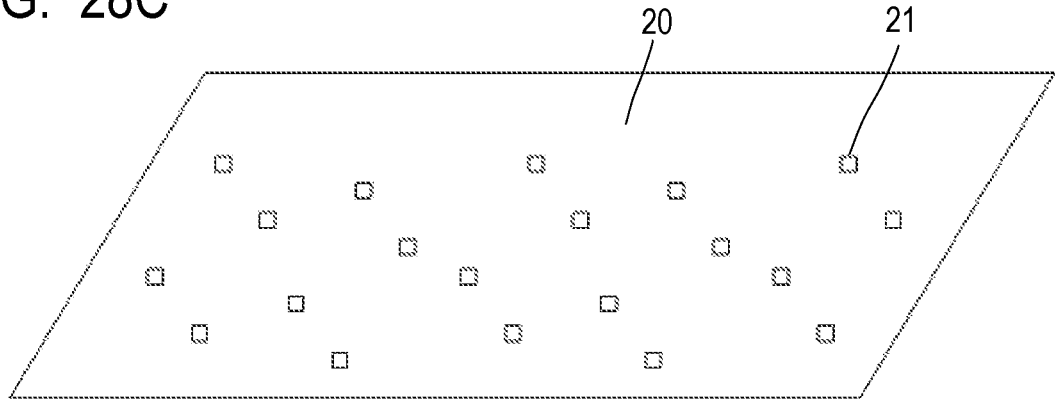

FIGS. 28A to 28C are diagrams for explaining the structure of the element substrate 10 according to this embodiment. FIG. 28A is a plan view of the surface of the element substrate 10 where the ejection ports 13 are formed. FIG. 28B is an enlarged view of a portion indicated by 28B in FIG. 28A. FIG. 28C is a plan view of the reverse side of the surface shown in FIG. 28A. As shown in FIG. 28A, an ejection port formation member 12 in the element substrate 10 has four ejection port arrays formed therein corresponding to the respective colors. The structures of the ejection ports 13, the pressure chambers 23, and the like as well as the fluid-flowable connection relationship are the same as those of the element substrate 10 according to the first embodiment shown in FIGS. 8A to 8C and FIG. 9. However, this embodiment is different from the first embodiment in that three openings 21 are provided for one liquid supply path 18 and two for one liquid collection path 19.

Next, description is given of a flow of the liquid inside the element substrate 10. FIG. 29 is a cross-sectional perspective view taken along the line 29-29 in FIG. 28A, showing the element substrate 10 and the cover member 20. The element substrate 10 is formed by laminating a substrate 11 made of Si and the ejection port formation member 12 made of photosensitive resin, and the cover member 20 is attached to the back of the substrate 11. The recording elements 15 are formed in one side of the substrate 11, and channels are formed on the back side thereof, including the liquid supply paths 18 and liquid collection paths 19 extending along the ejection port arrays. The liquid supply paths 18 and liquid collection paths 19 formed by the substrate 11 and the cover member 20 are connected to the common supply channels 211 and the common collection channels 212 in the flow path member 210. A differential pressure is generated between the liquid supply paths 18 and the liquid collection paths 19. When recording is performed by ejecting the liquid from the plurality of ejection ports 13 in the liquid ejection unit 2, the differential pressure causes the liquid in the liquid supply paths 18 to flow to the liquid collection paths 19 through supply ports 17*a*, pressure chambers 23, and collection ports 17*b* at the ejection ports 13 engaged in no ejection. Such liquid flows (flows indicated by arrows C in FIG. 29) allow thickened ink due to evaporation from the ejection ports 13, bubbles, foreign objects, and the like to be collected to the liquid collection paths 19 at the ejection ports 13 engaged in no ejection and the pressure chambers 23. Moreover, thickening of the ink in the ejection ports 13 or the pressure chambers 23 can be suppressed. The liquid collected to the liquid collection paths 19 is collected sequentially to the communication ports 51, the individual collection channels 214, and the common collection channels 212 in the flow path member 210 through the openings 21 in the cover member 20 and the liquid communication ports 31 in the supporting member 30 (see FIG. 27B). Then, at the end, the liquid is collected to the supply flow path in the liquid ejection apparatus 1000.

(Description of Circulation Flow Path)

Figure 30:
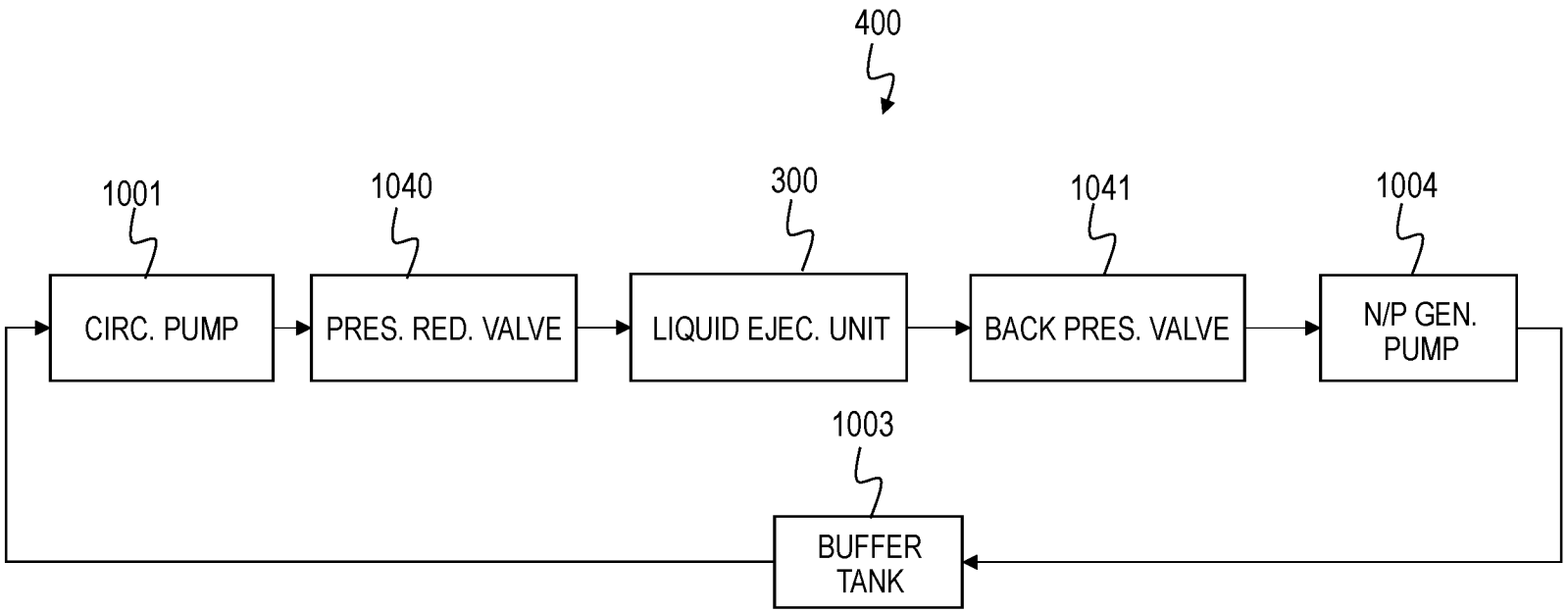
FIG. 30 is a block diagram showing a fluid circuit according to the fourth embodiment of the present disclosure.

FIG. 30 is a block diagram showing a fluid circuit according to this embodiment. In a fluid circuit 400 shown in FIG. 30, a pressure reducing valve 1040 is provided on a flow path between a circulation pump 1001 and a liquid ejection unit 300, while a back pressure valve 1041 is provided on a flow path between the liquid ejection unit 300 and a negative pressure generating pump 1004.

Figure 31:
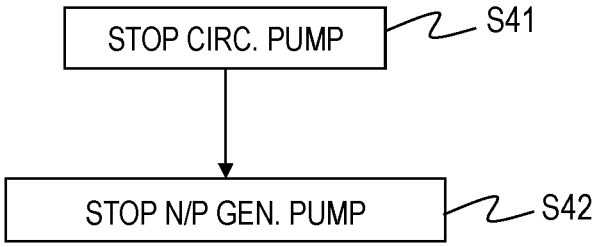
FIG. 31 is a flowchart for explaining a circulation stop operation according to the fourth embodiment of the present disclosure.

FIG. 31 is a flowchart for explaining a procedure for a circulation stop operation to stop the circulation of the liquid.

In the circulation stop procedure, first, the circulation of the liquid is stopped by stopping the circulation pump 1001 (Step S41), and then the negative pressure generating pump 1004 is stopped (Step S42). In this embodiment, again, the circulation pump 1001 is stopped first. Thus, the flow of the liquid can be stopped in a short period of time. Furthermore, the liquid can be prevented from being continuously supplied to the liquid ejection unit 300. Thus, the pressure in the liquid ejection head 2 can be prevented from being increased by the continuous supply of the liquid. Moreover, since the negative pressure generating section is stopped after the supply of the liquid is stopped, the downstream of the back pressure valve 1041 can be maintained in a state where a negative pressure is applied thereto. Therefore, the flow of the liquid can be stopped in a short period of time while suppressing the leakage of the liquid from the ejection ports 13. Note that a pressure change in each spot of the flow path when the circulation is stopped is the same as that shown in FIG. 13.

Moreover, the use of the pressure reducing valve 1040 and the back pressure valve 1041 as the negative pressure control unit 230 in this embodiment eliminates the need for using larger parts such as tanks as the negative pressure control unit 230, allowing for reduction in size of the liquid ejection unit 2.

Fifth Embodiment

A liquid ejection unit 300 according to this embodiment is the same as that of the fourth embodiment shown in FIG. 23 and the like.

Figure 32:
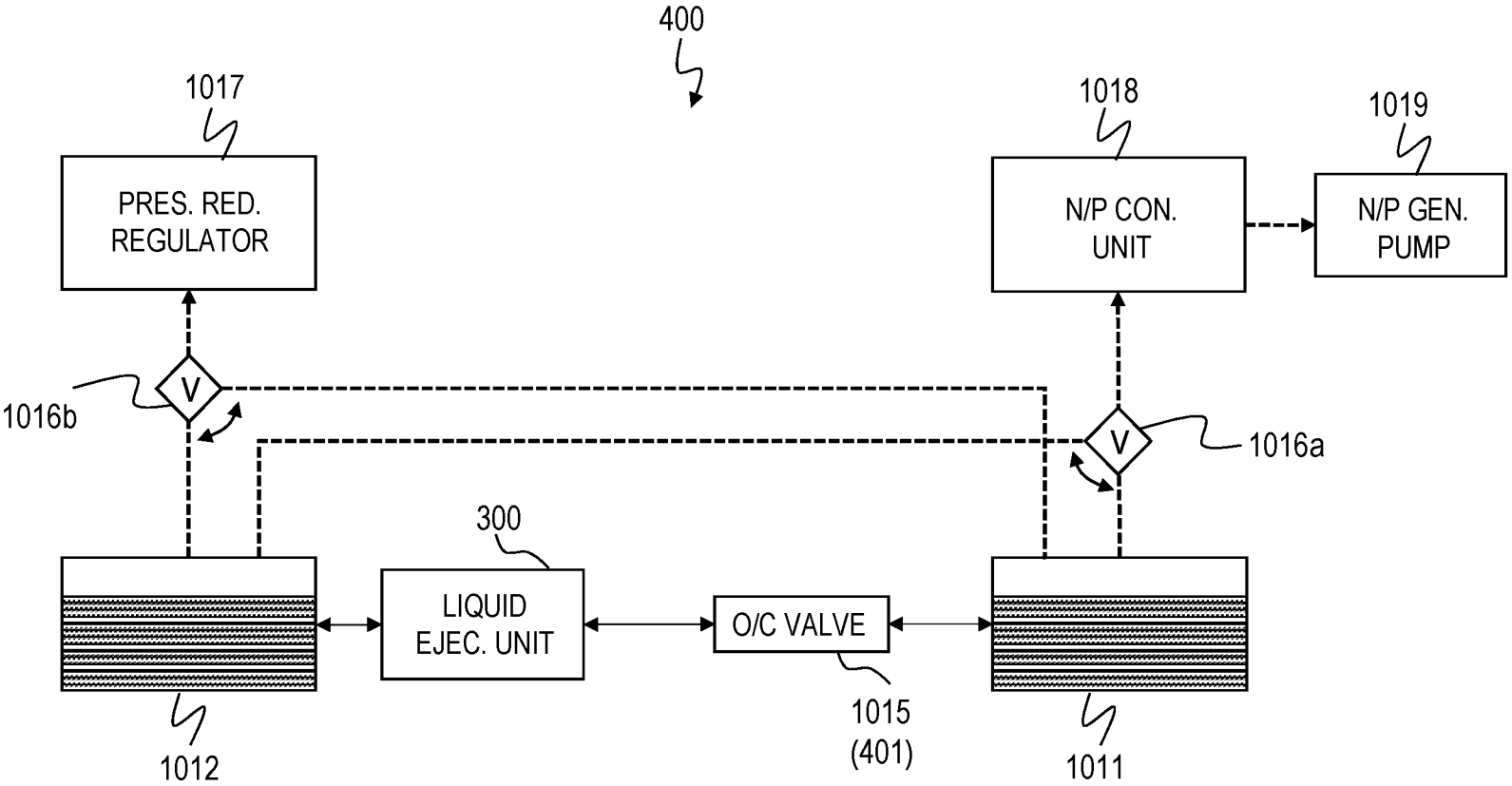
FIG. 32 is a block diagram showing a fluid circuit according to a fifth embodiment of the present disclosure.

FIG. 32 is a block diagram showing a fluid circuit according to this embodiment. In a fluid circuit 400 shown in FIG. 32, an opening/closing valve 1015 and a negative pressure tank 1011 are provided upstream of the liquid ejection unit 300, while a negative pressure tank 1012 is provided downstream of the liquid ejection unit 300. The opening/closing valve 1015 functions as a supply control section 401 to switch between the circulation of the liquid and stop thereof. The negative pressure tank 1011 is a first container communicating with common supply channels 211 in the liquid ejection unit 300 to store the liquid, while the negative pressure tank 1012 is a second container communicating with common collection channels 212 in the liquid ejection unit 300 to store the liquid.

Switching valves 1016*a* and 1016*b* are connected to the negative pressure tanks 1011 and 1012, respectively. The switching valves 1016*a* and 1016*b* form a switching section to connect one of the negative pressure tanks 1011 and 1012 to a negative pressure control unit 1018 and connect the other to a pressure reducing regulator 1017. Flow paths connecting the negative pressure tanks 1011 and 1012 to the negative pressure control unit 1018 and the pressure reducing regulator 1017 through the switching valves 1016*a* and 1016*b* are air flow paths for air to flow therethrough. Meanwhile, flow paths connecting the negative pressure tanks 1011 and 1012 to each other through the opening/closing valve 1015 and the liquid ejection unit 300 are liquid flow paths for the liquid to flow therethrough. In FIG. 32, the liquid flow paths are indicated by solid lines, while the air flow paths are indicated by broken lines. The pressure reducing regulator 1017 is a low negative pressure generating section that is opened to the atmosphere and uses the atmospheric pressure to perform low negative pressure control to apply a low negative pressure to the connected negative pressure tank 1011 or 1012. The negative pressure control unit 1018 is connected to a negative pressure generating pump 1019. The negative pressure control unit 1018 uses a negative pressure generated by the negative pressure generating pump 1019 to perform high negative pressure control to apply a high negative pressure to the connected negative pressure tank 1011 or 1012. The high negative pressure to be applied by the negative pressure control unit 1018 is a negative pressure higher than the low negative pressure applied by the pressure reducing regulator 1017.

In the above configuration, for example, the switching valves 1016*a* and 1016*b* are used to connect the pressure reducing regulator 1017 to the negative pressure tank 1012 and connect the negative pressure control unit 1018 to the negative pressure tank 1011. In this case, a pressure difference between the pressure reducing regulator 1017 and the negative pressure control unit 1018 causes the liquid to flow from the negative pressure tank 1012 to the negative pressure tank 1011. On the other hand, when the switching valves 1016*a* and 1016*b* are used to connect the pressure reducing regulator 1017 to the negative pressure tank 1011 and connect the negative pressure control unit 1018 to the negative pressure tank 1012, a pressure difference therebetween causes the liquid to flow from the negative pressure tank 1011 to the negative pressure tank 1012. Thus, in this embodiment, flow directions in which the liquid flows (circulation directions in which the liquid is circulated) can be switched.

Figure 33:
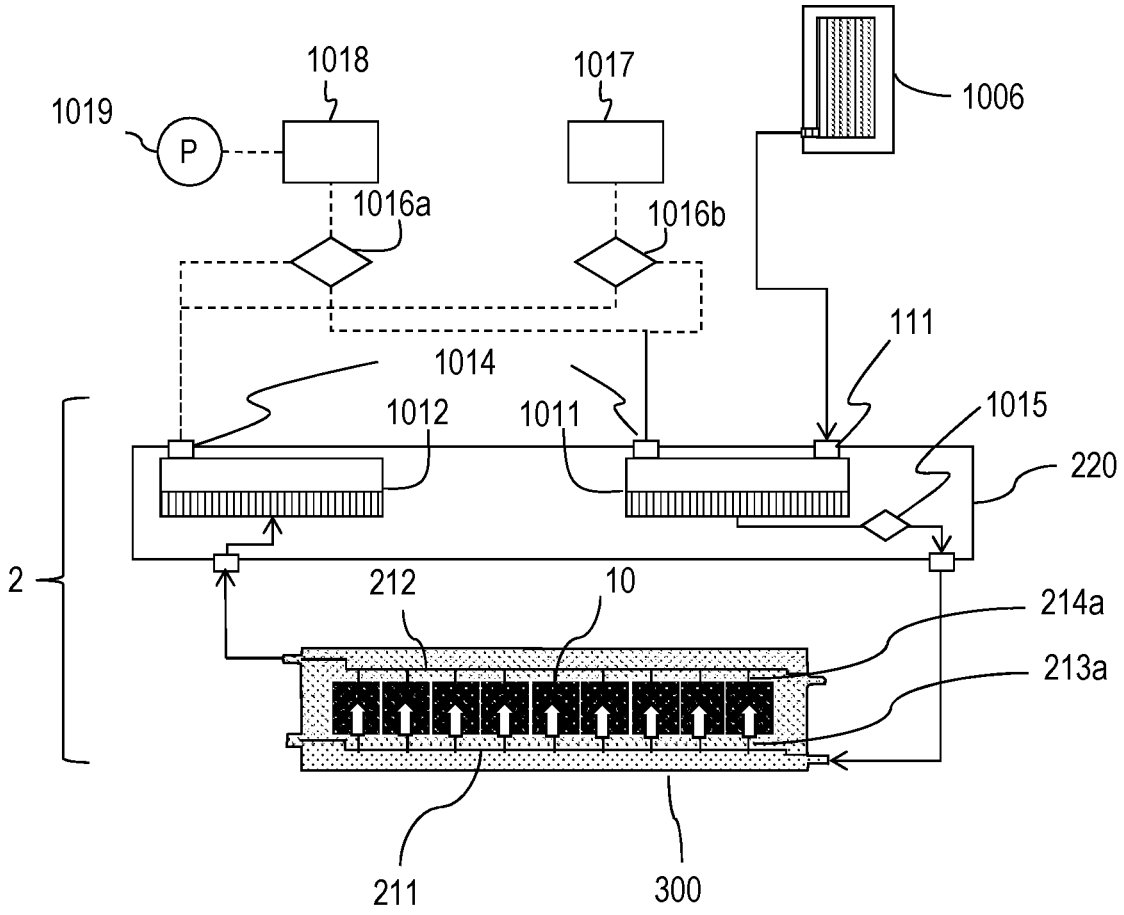
FIG. 33 is a schematic view showing a liquid circulation flow path according to the fifth embodiment of the present disclosure.

FIG. 33 is a schematic diagram showing a circulation flow path to circulate the liquid according to this embodiment. Although, to simplify the illustration, FIG. 33 only shows a flow path through which a liquid of one of four colors flows, circulation flow paths for the four colors are provided in the main body of the liquid ejection apparatus 1000.

As shown in FIG. 33, the negative pressure tank 1011 communicates with the common supply channel 211 in the liquid ejection unit 300 through the opening/closing valve 1015, and the negative pressure tank 1012 is connected to the common collection channel 212 in the liquid ejection unit 300. A main tank 1006 is connected to the negative pressure tank 1011, and the liquid is supplied from the main tank 1006 through the liquid connection section 111.

Note that the common supply channel 211 and the common collection channel 212 in this embodiment can switch the circulation directions and thus are called for the descriptive purpose. In this embodiment, the flow path connected to the negative pressure tank 1011 connected to the main tank 1006 is called the common supply channel 211, while the flow path connected to the negative pressure tank 1012 is called the common collection channel 212.

The negative pressure tanks 1011 and 1012 are connected to either of the pressure reducing regulator 1017 and the negative pressure control unit 1018 through gas connection sections 1014 and the switching valves 1016*a* and 1016*b*. The negative pressure tanks 1011 and 1012 have the pressure controlled by the connected regulator, either the pressure reducing regulator 1017 or the negative pressure control unit 1018.

The pressure reducing regulator 1017 operates so as to maintain a low set pressure by allowing air of the atmospheric pressure to flow in when the pressure in the connected negative pressure tank 1011 or 1012 gets lower than a set pressure (for example, −0.5 kPa). The negative pressure control unit 1018 operates so as to maintain a high set pressure by opening a valve (not shown) between the negative pressure control unit 1018 and the negative pressure generating pump 1019 when the pressure in the connected negative pressure tank 1011 or 1012 gets higher than a set pressure (for example, −2.5 kPa).

When the negative pressure tank 1011 is connected to the pressure reducing regulator 1017 and the negative pressure tank 1012 is connected to the negative pressure control unit 1018, the negative pressure tank 1011 is set to a low negative pressure and the negative pressure tank 1012 is set to a high negative pressure. In this case, a flow from the common collection channel 212 to the common supply channel 211 through an internal flow path in the element substrate 10 (flow indicated by arrow C in FIG. 33) is generated.

On the other hand, when the negative pressure tank 1011 is connected to the negative pressure control unit 1018 and the negative pressure tank 1012 is connected to the pressure reducing regulator 1017, the negative pressure tank 1011 is set to a high negative pressure and the negative pressure tank 1012 is set to a low negative pressure. In this case, a flow from the common collection channel 212 to the common supply channel 211 through an internal flow path in the element substrate 10 (flow opposite to arrow C in FIG. 33) is generated.

Thus, in this embodiment, since no pump is required to circulate the liquid, a circulation flow path can be formed in a simple manner at low cost. Furthermore, since the air flow paths can be shared by the respective colors, the size and cost of the liquid ejection apparatus 1000 can be reduced.

(Description of Circulation Control)

The negative pressure tanks 1011 and 1012 each include a liquid-level detection sensor (not shown), and the circulation direction is controlled based on a result of detection by the liquid-level detection sensor.

For example, when an empty state is detected by both of the liquid-level sensors of the negative pressure tanks 1011 and 1012, the switching valves 1016*a* and 1016*b* are used to connect the negative pressure control unit 1018 to the negative pressure tank 1011 and connect the pressure reducing regulator 1017 to the negative pressure tank 1012. Then, the opening/closing valve 1015 is closed. Furthermore, the liquid is supplied from the main tank 1006 to the negative pressure tank 1011 by opening a communication valve (not shown) located between the negative pressure control unit 1018 and the negative pressure generating pump 1019 to apply a high negative pressure generated by the negative pressure generating pump 1019 to the negative pressure tank 1011.

When liquid supply up to a predetermined level is detected by the liquid-level sensor of the negative pressure tank 1011, the communication valve in the negative pressure control unit 1018 is closed. Then, the switching valves 1016*a* and 1016*b* are used to connect the pressure reducing regulator 1017 to the negative pressure tank 1011 and connect the negative pressure control unit 1018 to the negative pressure tank 1012. Thereafter, the opening/closing valve 1015 is opened to cause the liquid to flow from the common supply channel 211 to the common collection channel 212, thereby starting the circulation of the liquid.

Subsequently, when an empty state is detected by the liquid-level sensor of the negative pressure tank 1011, the switching valves 1016*a* and 1016*b* are used to connect the pressure reducing regulator 1017 to the negative pressure tank 1012 and connect the negative pressure control unit 1018 to the negative pressure tank 1011. Thus, the flow directions of the liquid are reversed, and thus the liquid flows from the common collection channel 212 to the common supply channel 211. Then, when an empty state is detected by the liquid-level sensor of the negative pressure tank 1012, the flow direction of the liquid is reversed again by connecting the pressure reducing regulator 1017 to the negative pressure tank 1011 and the negative pressure control unit 1018 to the negative pressure tank 1012. The circulation of the liquid can be continuously performed by repeating the above procedure.

(Description of Circulation Stop Procedure)

Figure 34:
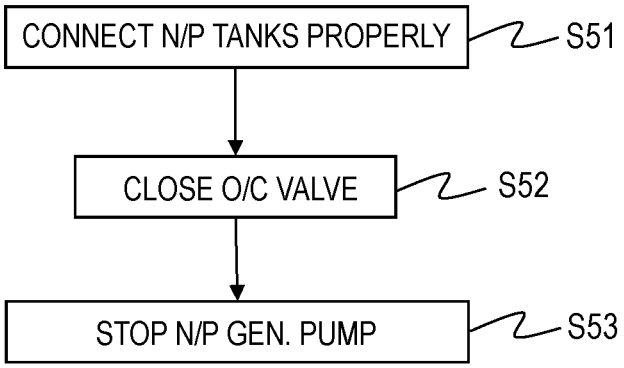
FIG. 34 is a flowchart for explaining a circulation stop operation according to the fifth embodiment of the present disclosure.

FIG. 34 is a flowchart for explaining a procedure for a circulation stop operation to stop the circulation of the liquid according to this embodiment.

In the circulation stop operation, first, the switching valves 1016*a* and 1016*b* are used to connect the pressure reducing regulator 1017 to the negative pressure tank 1011 and connect the negative pressure control unit 1018 to the negative pressure tank 1012 (Step S51). Then, the circulation of the liquid is stopped by closing the opening/closing valve 1015 (Step S52). Thus, since a negative pressure set by the negative pressure control unit 1018 is applied to the common supply channel 211 and the common collection channel 212, the same negative pressure is also applied to the ejection ports 13. Then, the negative pressure generating pump 1019 is stopped (Step S53). Accordingly, the negative pressure in the liquid ejection unit 2 can be maintained by a residual negative pressure between the negative pressure generating pump 1019 and the negative pressure control unit 1018. Therefore, in this embodiment, again, the flow of the liquid can be stopped in a short period of time while suppressing the leakage of the liquid from the ejection ports 13.

Note that, in the above operation, the negative pressure control unit 1018 is stopped during the circulation stop operation, and the flow of the liquid is stopped by the opening/closing valve 1015. Thus, the pressure reducing regulator 1017 with the low negative pressure is connected to the negative pressure tank 1011 connected to the opening/closing valve 1015. When the opening/closing valve 1015 is disposed on the negative pressure tank 1012 side, the pressure reducing regulator 1017 with the low negative pressure is connected to the negative pressure tank 1011 in an opposite manner to the above example.

Figure 35:
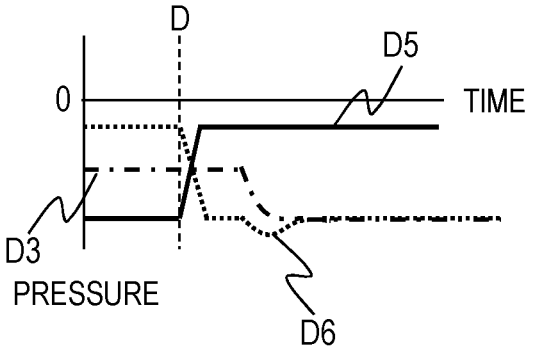
FIG. 35 is a diagram showing a pressure change according to the fifth embodiment of the present disclosure.

FIG. 35 is a conceptual diagram showing a pressure change in each spot of the flow path when the circulation is stopped. A line D3 represents a pressure change in the ejection port 13, a line D5 represents a pressure change in the negative pressure tank 1011, and a line D6 represents a pressure change in the negative pressure tank 1012.

First, when the negative pressure tank 1011 is connected to the pressure reducing regulator 1017 on the low negative pressure side and the negative pressure tank 1012 is connected to the negative pressure control unit 1018, the pressure in the negative pressure tank 1011 and the pressure in the negative pressure tank 1012 are reversed. Then, as the opening/closing valve 1015 is closed, the pressure in the negative pressure tank 1011 is maintained at a certain value, while the pressure in the negative pressure tank 1012 is slightly reduced by the characteristics of the negative pressure control unit 1018. The pressure in the ejection port 13 gradually approaches the pressure in the negative pressure tank 1012 and stays constant at a high negative pressure.

Note that, in this embodiment, a valve to be closed when the power is off is used as the opening/closing valve 1015. As the switching valves 1016*a* and 1016*b*, valves that connect the pressure reducing regulator 1017 to the negative pressure tank 1011 and connect the negative pressure control unit 1018 to the negative pressure tank 1012 are used. By using such valves, the liquid can be prevented from leaking from the ejection ports 13 even when the power is shut down in an abnormal state.

The configurations illustrated in the respective embodiments described above are merely an example, and the present disclosure is not limited to those configurations.

According to the present disclosure, to stop the flow of the liquid, the supply of the liquid is stopped, and then the negative pressure generating section is stopped. Thus, since the supply of the liquid is stopped first, the flow of the liquid can be stopped in a short period of time. Moreover, since the negative pressure generating section is stopped after the supply of the liquid is stopped, the ejection ports can be maintained in a state where the negative pressure is applied thereto through the flow path by the negative pressure control section. Therefore, the flow of the liquid can be stopped in a short period of time while suppressing the leakage of the liquid from the ejection ports.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2017-133995, filed Jul. 7, 2017, which is hereby incorporated by reference herein in its entirety.

What is claimed is:

1. A method for controlling a liquid ejection apparatus including an ejection port that ejects a liquid, a pressure chamber communicating with the ejection port and having therein an energy generating element to generate energy for ejecting the liquid, first and second flow paths communicating with the pressure chamber to supply the liquid to the pressure chamber and to collect the liquid from the pressure chamber, a negative pressure generating section configured to generate a negative pressure, a negative pressure control section using the negative pressure generated by the negative pressure generating section to adjust a pressure of the liquid flowing through one of the first and second flow paths that is connected, and a supply control section configured to control the supply of the liquid to the pressure chamber and the stop of the supply, the method comprising:

stopping a flow of the liquid by stopping the supply of the liquid by the supply control section and then stopping the negative pressure generating section, wherein the supply control section is a circulation pump, wherein the liquid ejection apparatus further includes a storage container configured to store the liquid, the storage container having a water head lower than a pressure applied by the negative pressure control section, and a first pressure control valve connected in parallel with the circulation pump, the circulation pump and the pressure control valve communicating with the storage container, and wherein the first pressure control valve is opened after the negative pressure generating section is stopped.

2. The method for controlling a liquid ejection apparatus according to claim 1, wherein the liquid ejection apparatus further includes a flow path opening/closing valve provided on a flow path between the negative pressure control section and the negative pressure generating section, and the flow path opening/closing valve is closed after the first pressure control valve is opened.

3. The method for controlling a liquid ejection apparatus according to claim 1, wherein the liquid ejection apparatus further includes a second pressure control valve connected in parallel with the negative pressure generating section, and the second pressure control valve is opened after the negative pressure generating section is stopped.

4. The method for controlling a liquid ejection apparatus according to claim 1, wherein the supply control section is provided upstream of the pressure chamber for each of the first and second flow paths, and the negative pressure control section is provided downstream of the pressure chambers for each of the first and second flow paths.

5. The method for controlling a liquid ejection apparatus according to claim 1, wherein the negative pressure control section includes a pressure reducing valve provided between the supply control section and the pressure chamber, and a back pressure valve provided between the pressure chamber and the negative pressure generating section.

6. The method for controlling a liquid ejection apparatus according to claim 1, wherein the liquid ejection apparatus includes a first container communicating with the first flow path and configured to store the liquid, a second container communicating with the second flow path and configured to store the liquid, a low negative pressure generating section configured to generate a low negative pressure higher than the pressure in the negative pressure control section, and a switching section configured to connect one of the first and second containers to the negative pressure control section and to connect the other to the low negative pressure generating section, wherein the supply control section is provided on a flow path between the first flow path and the first container, and wherein, to stop the flow of the liquid, the switching section is used to connect the first container to the low negative pressure generating section and to connect the second container to the negative pressure control section, and then the supply control section stops the supply of the liquid.

7. The method for controlling a liquid ejection apparatus according to claim 1, wherein the liquid in the pressure chamber is circulated through the first flow path and the second flow path.

* * * * *